US011291891B2

(12) United States Patent
Morales et al.

(10) Patent No.: US 11,291,891 B2
(45) Date of Patent: Apr. 5, 2022

(54) GOLF CLUB HEAD HAVING DEFLECTION FEATURES AND RELATED METHODS

(71) Applicant: KARSTEN MANUFACTURING CORPORATION, Phoenix, AZ (US)

(72) Inventors: Eric J. Morales, Laveen, AZ (US); Ryan M. Stokke, Anthem, AZ (US); David L. Petersen, Peoria, AZ (US); Eric V. Cole, Phoenix, AZ (US); Cory S. Bacon, Phoenix, AZ (US); Les J. Bryant, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/888,496

(22) Filed: May 29, 2020

(65) Prior Publication Data

US 2020/0289902 A1 Sep. 17, 2020

Related U.S. Application Data

(63) Continuation of application No. 15/899,261, filed on Feb. 19, 2018, now Pat. No. 10,668,338, which is a (Continued)

(51) Int. Cl.
*A63B 53/04* (2015.01)
*A63B 60/02* (2015.01)
(Continued)

(52) U.S. Cl.
CPC ..... *A63B 53/0475* (2013.01); *A63B 53/047* (2013.01); *A63B 60/02* (2015.10);
(Continued)

(58) Field of Classification Search
CPC ..... A63B 53/045; A63B 53/0454; A63B 53/0475; A63B 53/047; A63B 53/042;
(Continued)

(56) References Cited

U.S. PATENT DOCUMENTS 4,043,563 A 8/1977 Churchward
4,085,934 A 4/1978 Churchward
(Continued)

FOREIGN PATENT DOCUMENTS

EP 622094 2/1994
JP 1133147 2/1999

OTHER PUBLICATIONS

International Search Report and Written Opinion for PCT Application No. PCT/US2017/026005, 10 pages, dated Jun. 20, 2012.

*Primary Examiner* — Sebastiano Passaniti

(57) ABSTRACT

Described herein is a golf club head comprising a deflection feature to increased ball speed and launch distance, while producing desirable acoustics and optimized mass distribution. The deflection feature can include any one of or any combination of an insert comprising a gap, an insert comprising voids, a thin uniform sole, a cutout in the top rail, optimized face material, a thin sole, a reinforcement device, or a multi material weight. The rear cavity insert comprises voids within the body of the insert providing a change of insert density. The faceplate comprises a reinforcement element allowing the faceplate thickness to be reduced while simultaneously reducing faceplate stress.

18 Claims, 18 Drawing Sheets

Related U.S. Application Data continuation-in-part of application No. 15/479,049, filed on Apr. 4, 2017, now Pat. No. 10,022,601, and a continuation-in-part of application No. 14/710,236, filed on May 12, 2015, now Pat. No. 10,905,925, and a continuation-in-part of application No. 15/470,369, filed on Mar. 27, 2017, now Pat. No. 10,112,084.

(60) Provisional application No. 62/460,505, filed on Feb. 17, 2017, provisional application No. 62/407,736, filed on Oct. 13, 2016, provisional application No. 62/318,017, filed on Apr. 4, 2016, provisional application No. 62/146,783, filed on Apr. 13, 2015, provisional application No. 62/101,926, filed on Jan. 9, 2015, provisional application No. 62/023,819, filed on Jul. 11, 2014, provisional application No. 61/994,029, filed on May 15, 2014, provisional application No. 62/313,214, filed on Mar. 25, 2016.

(51) Int. Cl.
*A63B 60/54* (2015.01)
*A63B 60/00* (2015.01)

(52) U.S. Cl.
CPC ..... *A63B 53/042* (2020.08); *A63B 53/0433* (2020.08); *A63B 53/0445* (2020.08); *A63B 53/0454* (2020.08); *A63B 53/0458* (2020.08); *A63B 60/002* (2020.08); *A63B 60/54* (2015.10); *A63B 2053/0491* (2013.01)

(58) Field of Classification Search
CPC ..... A63B 53/0433; A63B 53/0445; A63B 53/0458; A63B 2053/0491; A63B 60/02; A63B 60/54; A63B 60/002
USPC ..... 473/324–350, 287–292
See application file for complete search history.

(56) References Cited

U.S. PATENT DOCUMENTS 4,695,054 A 9/1987 Tunstall
5,190,290 A 3/1993 Take
5,544,885 A * 8/1996 Besnard ..... A63B 60/00 473/350
5,720,673 A 2/1998 Anderson
5,766,094 A 6/1998 Mahaffey
5,776,011 A * 7/1998 Su ..... A63B 53/04 473/345
5,863,261 A 1/1999 Eggiman
5,913,735 A 6/1999 Kenmi
5,944,619 A 8/1999 Cameron
6,319,149 B1 11/2001 Lee
6,592,468 B2 7/2003 Vincent
6,592,469 B2 7/2003 Gilbert
6,699,140 B1 3/2004 Sun
6,743,114 B2 6/2004 Best
6,800,038 B2 * 10/2004 Willett ..... A63B 53/0466 473/329
6,811,496 B2 11/2004 Wahl
6,921,344 B2 7/2005 Gilbert et al.
7,086,964 B2 8/2006 Chen
D547,410 S 7/2007 Nicolette et al.
7,485,049 B2 2/2009 Gilbert et al.
7,601,077 B2 10/2009 Serrano et al.
7,789,771 B2 9/2010 Park et al.
7,811,180 B2 10/2010 Roach et al.
8,221,263 B2 7/2012 Tavares et al.
8,235,842 B2 8/2012 Cole
8,277,337 B2 10/2012 Hideo
8,496,541 B2 * 7/2013 Beach ..... A63B 60/00 473/307
8,517,859 B2 8/2013 Golden et al.
8,535,177 B1 * 9/2013 Wahl ..... A63B 60/54 473/350
8,657,701 B2 * 2/2014 Boyd ..... A63B 53/0466 473/329
8,758,163 B2 6/2014 Stites
8,801,540 B2 8/2014 Hebreo et al.
9,168,436 B2 * 10/2015 Slaughter ..... A63B 60/00
9,283,448 B2 3/2016 Sander
9,358,432 B2 6/2016 Boggs
9,370,697 B2 6/2016 Beno et al.
9,545,548 B2 1/2017 Petersen
9,623,296 B2 4/2017 Nicolette et al.
10,022,601 B2 7/2018 Petersen et al.
10,258,843 B2 * 4/2019 Morales ..... A63B 53/047
10,668,338 B2 * 6/2020 Morales ..... A63B 53/0475
10,751,587 B2 * 8/2020 Clarke ..... A63B 53/047
10,905,925 B2 * 2/2021 Morales ..... A63B 60/54
10,905,926 B2 * 2/2021 Morales ..... A63B 60/54
10,918,919 B2 * 2/2021 Morales ..... A63B 53/0433
2003/0092502 A1 5/2003 Pergande et al.
2004/0176178 A1 9/2004 Best
2005/0009623 A1 1/2005 Dickinson
2005/0049075 A1 3/2005 Chen
2005/0148407 A1 7/2005 Gilbert et al.
2007/0155534 A1 7/2007 Tsai et al.
2008/0058113 A1 3/2008 Nicolette
2011/0250985 A1 10/2011 Stites
2016/0346638 A1 * 12/2016 Snyder ..... A63B 53/047

* cited by examiner

GOLF CLUB HEAD HAVING DEFLECTION FEATURES AND RELATED METHODS

CROSS REFERENCE TO RELATED APPLICATIONS

This is a continuation of U.S. patent application Ser. No. 15/899,261 filed Feb. 19, 2018, which claims the benefit of U.S. Provisional Patent Application No. 62/460,505, filed on Feb. 17, 2017. Further, this is a continuation in part of U.S. patent application Ser. No. 15/479,049, filed on Apr. 4, 2017, which claims the benefit of U.S. Provisional Patent Application No. 62/407,736, filed on Oct. 13, 2016, and U.S. Provisional Patent Application No. 62/318,017 filed on Apr. 4, 2016. Further still, this is a continuation in part of U.S. patent application Ser. No. 14/710,236, filed on May 12, 2015, which claims the benefit of U.S. Provisional Patent Application No. 62/146,783 filed on Apr. 13, 2015, U.S. Provisional Patent Application No. 62/101,926 filed on Jan. 9, 2015, U.S. Provisional Patent Application No. 62/023,819 filed on Jul. 11, 2014, and U.S. Provisional Patent Application No. 61/994,029, filed on May 15, 2014. Further still, this claims the benefit of U.S. patent application Ser. No. 15/470,369, filed on Mar. 27, 2017, which claims the benefit of U.S. Provisional Patent Application No. 62/313,214, filed on Mar. 25, 2016. The contents of all of the above-described applications are incorporated fully herein by reference.

FIELD OF THE INVENTION

The present disclosure relates to a golf club head including multiple features to optimize ball speed and launch distance, while not compromising the acoustics produced by the golf club head after the point of impact.

BACKGROUND

A golfer benefits from having a club that provides high ball speed and greater carry distance. Many golf club characteristics are considered when designing a golf club head to achieve desired performance characteristics, such as distribution of mass, energy transferred to the ball from the face, along with the acoustics produced by the club head after impact.

Various iron-type golf club heads include a void positioned behind the face, and a weight or insert positioned in the void to provide desired weighting characteristics to the club head. The weight or insert generally contacts the back side of the face, thereby damping vibrations at impact to create a desirable sound after impact with a golf ball. The insert placed in contact with the face also leaches energy from the impact, energy that is prevented from being transferred back into the golf ball to increase the ball speed after impact. There is a need in the art for a golf club head that produces desirable acoustics and proper swingweighting, while also transferring a maximum amount of energy back into the golf ball after the point of impact.

DETAILED DESCRIPTION

Figure 1:
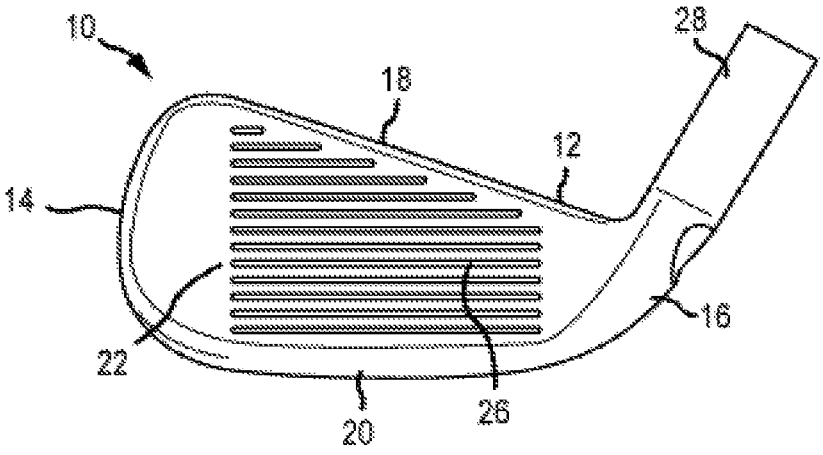
FIG. 1 is a front view of a golf club head having a deflection feature according to one embodiment.

Described herein is an iron-type golf club head having various features to increase ball speed and ball launch distance, while producing desirable acoustics, optimized mass distribution, and maintaining a small body size (i.e. a compact distance iron). Specifically, the compact distance iron can include a face comprising an optimized material, a rear cavity positioned behind the face, an insert positioned behind the face, a reinforcement device, a thinned uniform sole, and a top rail comprising a cutout. Additionally, the golf club head can be formed as a single unibody cast, significantly reducing the cost of manufacturing.

The insert can comprise specific geometries, which allow the insert to positively damp vibrations in the club head, manipulate the mass distribution for proper swing weighting, while still allowing the face to deflect and transfer a maximum amount of energy back to the golf ball at impact. The insert can contact the rear surface of the face at certain locations and be spaced a predetermined distance from the face in areas which the ball is most likely to contact the face. In other embodiments, an entire surface of the insert can contact the rear surface of the face. The insert can also include voids, which allow the face to deform without absorbing energy from the impact, while damping vibrations at impact to generate the desired acoustics. Different geometries of voids can be used to adjust the face deflection on impact, swing weighting, and/or the sound emitted by the golf club at impact. Further, the voids can ensure the face of the golf club head is able to deflect, while minimizing energy loss to the insert. Therefore, the face is able to maximize the amount of energy transferred back to the golf ball after impact, resulting in increased ball speeds and greater launch distances.

In some embodiments, the insert can comprise a reinforcement device that can transfer stress away from the face and into the reinforcement device to support a thin face. The thin face can deflect more on impact with a golf ball (compared to a typical thicker face), thereby increasing energy transfer back to the ball on impact, resulting in increased ball speed and travel distance.

In many embodiments, the reinforcement device can comprise a face surface nearer to the rear surface proximal to the face center than proximal to the face perimeter, an outer perimeter surface that is filleted with the rear surface, an inner surface comprising a largest rib span of greater than or equal to approximately 0.609 centimeter to approximately 1.88 centimeters, and/or a face element that is thinner within the inner perimeter surface that without or outside the outer perimeter surface.

The club head having the reinforcement device with one or more of the aforementioned features experiences increased ball speed and travel distance, while maintaining club head durability compared to a club head devoid of the reinforcement device. The disclosed club head having a reinforcement element and fillet allows the center face plat thickness to be reduced without increasing (in fact, while reducing) the stress on the faceplate, due to the unique stress transfer properties of the described structure. The reduced center thickness of the club head having the reinforcement device further allows increased bending on impact with a golf ball, without sacrificing durability, thereby increasing ball speed and travel distance.

In many embodiments, the golf club head is an iron type golf club head. In other embodiments, the golf club head can be any type of golf club head. For example, the club head can be a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter.

In addition, the golf club head can have a loft that can range from approximately 3 degrees to approximately 75 degrees. For example, the golf club head can have a loft of 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20, 20.5, 21, 21.5, 22, 22.5, 23, 23.5, 24, 24.5, 25, 25.5, 26, 26.5, 27, 27.5, 28, 28.5, 29, 29.5, 30, 30.5, 31, 31.5, 32, 32.5, 33, 33.5, 34, 34.5, 35, 35.5, 36, 36.5, 37, 37.5, 38, 38.5, 39, 39.5, 40, 40.5, 41, 41.5, 42, 42.5, 43, 43.5, 44, 44.5, 45, 45.5, 46, 46.5, 47, 47.5, 48, 48.5, 49, 49.5, 50, 50.5, 51, 51.5, 52, 52.5, 53, 53.5, 54, 54.5, 55, 55.5, 56, 56.5, 57, 57.5, 58, 58.5, 59, 59.5, 60, 60.5, 61. 61.5, 62, 62.5, 63, 63.5, 64, 64.5, 65, 65.5, 66, 66.5, 67, 67.5, 68, 68.5, 69, 69.5, 70, 70.5, 71, 71.5, 72, 72.5, 73, 73.5, 74, 74.5, and/or 75 degrees). In many embodiments, the club head can have a loft greater than or equal to 15 degrees, greater than or equal to 20 degrees, greater than or equal to 25 degrees, greater than or equal to 30 degrees, greater than or equal to 45 degrees, greater than or equal to 50 degrees, or greater than or equal to 55 degrees.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but can include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 2:
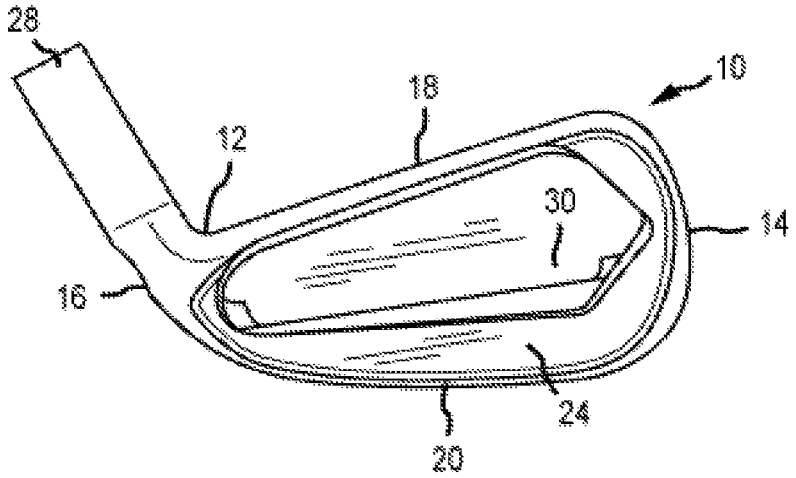
FIG. 2 is a back view of the golf club head of FIG. 1.

FIGS. 1 and 2 illustrate a golf club head 10 comprising a body 12 having a toe end 14 opposite a heel end 16, a top rail 18 opposite the sole 20, and a face 22 opposite a rear end 24. A plurality of grooves 26 can be positioned on the face 22. The golf club head 10 can also include a hosel 28 configured to receive a golf club shaft (not shown) that can include a grip (not shown).

Figure 3:
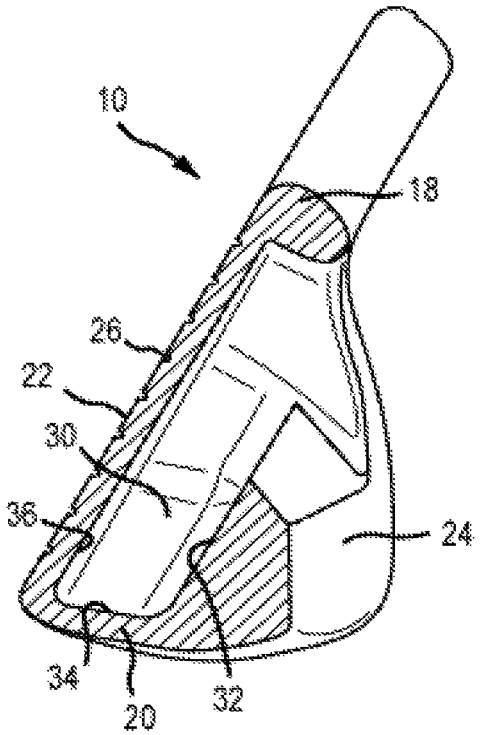
FIG. 3 is a toe side cross-sectional view of the golf club head of FIG. 1.

Referring now to FIG. 3, the golf club head 10 comprises a cavity 30 that is formed between the face 22 and the rear end 24. More specifically, the cavity 30 is partially formed by an interior wall 32 of the rear end 24, by a sole interior surface 34, and by a face interior surface 36. During impact with a golf ball the face 22 deflects towards the rear end 24 of the golf club head 10 and then springs forward imparting energy into the golf ball (not shown) upon impact.

The golf club head 10 can further include at least one deflection feature. The deflection feature can be an insert positioned in the cavity 30. The golf club head 10 can further include one or more features selected from the group consisting of a thin uniform sole 20, one or more optimized face 22 materials, a cutout in the top rail 18 of the golf club head 10, a thin face, and a reinforcement device 1112. The golf club head 10 can comprise one of or any combination of the aforementioned features. The weight savings produced by the aforementioned deflection features allow the golf club head 10 to further comprise a dual density weight. In some embodiments, the weight can be added to move the club head center of gravity low and back, while increasing club head moment of inertia. Further, the golf club head 10 comprising the aforementioned features can be a single cast unibody reducing the manufacturing costs.

I) Deflection Feature Comprising an Insert

As discussed above, the deflection feature of the golf club head 10 can comprise an insert (e.g. 50, 150, 250, 350, 450, as described below). In some embodiments, the insert can be positioned within the cavity 30. The insert can provide multiple benefits to the golf club head 10. First, the insert can aid in swing weighting the golf club head 10. Second, the insert can damp unwanted vibrations within the club head 10 to adjust the acoustics of the golf club head 10. Third, the insert can provide the aforementioned benefits without inhibiting deflection of the face 22, thereby minimizing the absorption of energy from the face deflection during impact to increase energy transfer to the golf ball, increase ball speed and carry distance, and damp vibrations.

The insert has a spring constant defined by Hooke's law. An insert having a low spring constant requires less force to deform the insert. Therefore, an insert with a low spring constant will deform more on impact with a golf ball, beneficially preventing unneeded absorption of energy from the impact, and enabling deformation of the face 22. The spring constant, k, can be determined using Hooke's Law in relation 1 below, where X represents the distance of compression due to a force, F:

$$k=F/X \qquad \text{Relation 1}$$

Both the geometry and the material of the insert can affect the spring constant. Generally, a material having a higher density has a greater spring constant. The insert can comprise one or more materials, including, but not limited to, steel, tungsten, aluminum, titanium, metal alloys, other metals, composites, polymers, plastic, plastics with powdered metals, elastomers, elastomers with powdered metals, and/or any combination thereof. In some embodiments, the insert can be made of the same material(s) or can be made of material(s) different than the golf club head 10. In some embodiments, the insert can comprise two separate materials. The portion of the insert contacting the face can be a low density material having a low spring constant, while the rear portion of the insert can be a higher density material, functioning as a swing weight.

In addition, in many embodiments, the insert can be formed separately and inserted into the cavity 30 after manufacturing of the golf club head 10. In other embodiments, the insert can be formed in the cavity 30 during manufacturing of the golf club head 10 (e.g., during casting, forging, etc.). In these embodiments, the insert can be integrally formed as a unitary construction with the remainder of the golf club head 10.

The insert can comprise various geometries, as described in further detail below. In some embodiments, a gap is positioned between the face 22 and the insert. Placing a gap between the face 22 and the insert results in no energy being absorbed by the insert on impact with a golf ball. In other embodiments, the insert can comprise a plurality of voids. The plurality of voids can be positioned across the entire insert or in the portion of the insert contacting the face 22. The voids decrease the compression of the insert on impact with a golf ball, which lowers the spring constant, compared to an insert without voids.

a. Deflection Feature Comprising Insert with a Gap

Figure 4:
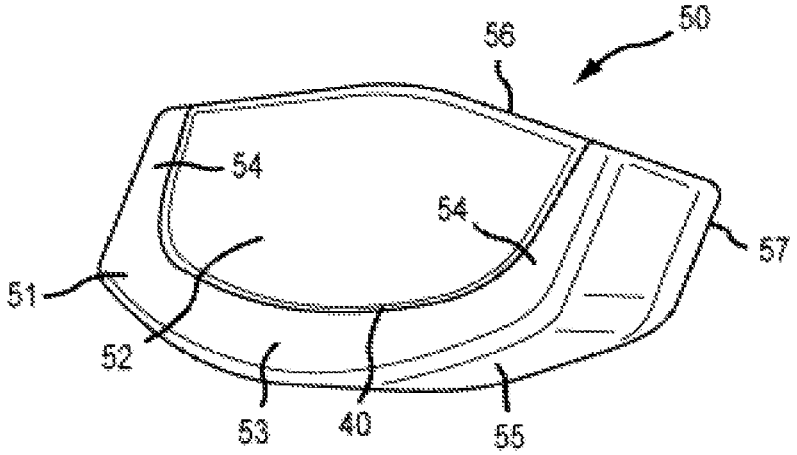
FIG. 4 is a perspective view of an insert according to one embodiment.

As discussed above, the deflection feature of the golf club head 10 can be an insert positioned such that a gap exists between the face 22 and the insert. Referring to FIG. 4, an embodiment of the insert 50 is displayed. The insert 50 comprises a front surface having a first surface 51 that is positioned adjacent to and offset from a second surface 52. A step 40 defines the transition between the first surface 51 and the second surface 52 of the insert 50. In the illustrated embodiment, the first surface 51 comprises a cross member 53 and two arm members 54, which form a "U" shaped protrusion extending outward from the second surface 52. The first surface 51 is protruded from the second surface 52 such that when positioned in the cavity 30 of the golf club head 10, the first surface 51 is in contact with the face interior surface 36, and the second surface 52 is spaced from the face interior surface 36. The insert 50 also includes a bottom surface 55 that is configured to contact the sole interior surface 34 of the cavity 30, a top surface 56 that is opposite the bottom surface 55, and a back surface 57 that is configured to contact the rear end interior surface 32. In other embodiments, the cross member 53 and two arm members 54, which form the first surface 51 can form any shape protruding from the second surface 52. For example, in some embodiments, the first surface 51 can form a triangular, circular, oval, rectangular, polygonal or any other suitable protruded shape extending from the second surface 52.

Figure 5:
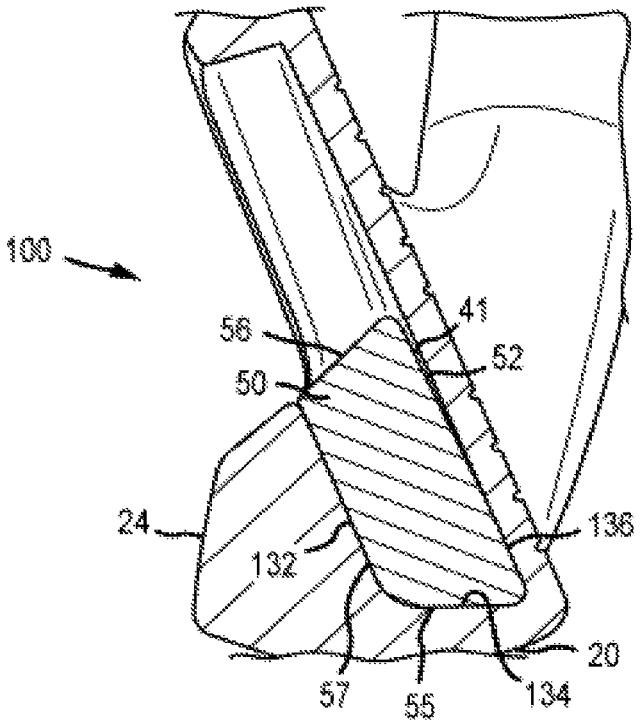
FIG. 5 is a toe side cross-sectional view of a golf club head comprising the insert of FIG. 4.

FIG. 5 illustrates the insert 50 in relation to the golf club head 100. The golf club head 100 is similar to golf club head 10, except golf club head 100 comprises insert 50. In the illustrated embodiment, the first surface 51 and second surface 52 of the insert 50 are positioned adjacent to the face interior surface 136. The first surface 51 contacts the outer perimeter of the face interior surface 136. The second surface 52 is offset from the first surface 51 by the step 40 and creates a gap 41 with the face interior surface 136. In the illustrated embodiment, the second surface 52 is tapered away from the face interior surface 136 at a tapering angle defined between the second surface 52 and the face interior surface 136. In some embodiments, the second surface 52 can have a tapering angle of greater than 0°, and more preferably can range from approximately 0.01° to approximately 20°, and more preferably can range from approximately 0.10° to approximately 15°, and more preferably can range from approximately 0.10° to approximately 10°, and more preferably can range from approximately 0.10° to approximately 5°, and more preferably can range from approximately 0.10° to approximately 2°, and more preferably can range from approximately 0.10° to approximately 1.5°, and more preferably can be at or less than approximately 10°, and more preferably can be at or less than approximately 7.5°, and more preferably can be at or less than approximately 5°, and more preferably can be at or less than approximately 3°, and more preferably can be at or less than approximately 2°, and more preferably can be at or less than approximately 1°. In other words, the gap 41 width, measured perpendicular from the face interior surface 136 to the second surface 52, increases from near the bottom surface 55 to the top surface 56. In other embodiments, the gap 41 width can decrease from near the bottom surface 55 to the top surface 56. Further, in other embodiments, the gap width can be greatest near the center of the face and can decrease radially toward the bottom surface 55, toward to toe end, and toward the heel end. In other embodiments, the second surface 52 can be parallel with the face interior surface 136 and therefore, the gap 41 width can remain constant from near the bottom surface 55 to the top surface 56. Further, the gap 41 width can increase, decrease or remain constant across the length (heel to toe) of the golf club head 100.

The gap 41 width can range from approximately 0.001 inches to approximately 0.125 inches, and more preferably can range from approximately 0.005 inches to approximately 0.125 inches, and more preferably can range from approximately 0.005 inches to approximately 0.075 inches, and more preferably can range from approximately 0.005 inches to approximately 0.050 inches. In addition, the maximum width of the gap 41 can exceed approximately 0.005 inches, and more preferably can exceed approximately 0.020 inches, and more preferably can exceed approximately 0.050 inches, and more preferably can exceed approximately 0.075 inches, and more preferably can be up to approximately 0.125 inches. The gap 41 can comprise 10-60% of the front surface of the insert 50. For example, in some embodiments, the gap 41 can comprise 10%, 15%, 20%, 25%, 30%, 35%, 40%, 45%, 50%, 55%, or 60% of the front surface of the insert 50.

During impact with a golf ball, the face 122 of the club head 100 having the insert 50 undergoes deformation or deflection. The face plate 122 deforms or deflects in a direction generally towards the rear end 124. The face plate 122 has the greatest deformation near the center of the face 122, wherein the gap 41 exists. In many embodiments, the width of the gap 41 is large enough that the face 122 never contacts the second surface 52 of the insert 50. The gap 41 is occupied by air and as such, has a spring constant of zero and does not inhibit deflection of the face 122. Therefore, the second surface 52 of the insert 50 does not absorb any energy from the impact with the golf ball and the face 122 is able to rebound transferring a majority of the energy from impact back to the golf ball. The first surface 51 of the insert 50 is positioned around the lower perimeter of the face interior surface 136, wherein the face 122 does not deflect. As such, the first surface 51 is able to damp vibrations caused by the impact, without inhibiting face 122 deflection or absorbing large amounts of energy. The result is a golf club head 100 comprising an insert 50, wherein the insert 50 damps vibration to achieve desired impact acoustics, while not inhibiting face 122 deflection. Further, the gap 41 positioned near the first and top surfaces 51, 56 of the insert 50, results in the insert 50 having a majority of its mass positioned towards its second and bottom surfaces 52, 55. Therefore, the insert 50 can also be utilized as a swing weight to move the CG of the golf club head 100 low and back, improving the MOI.

In other embodiments, the width of the gap 41 is less than the total deformation of the face 122. In these or other embodiments, during impact, the face 122 continues to deform or deflect until a portion of the gap 41, or the entirety of the gap 41, collapses. For example, at impact, the face 122 deforms or deflects until the face interior surface 136 impacts (or comes into contact with) the insert 50, and more specifically impacts the second surface 52 of the insert 50. In other embodiments, a portion of the gap 41 can partially or completely collapse. In yet other embodiments, a first portion of the gap 41 can partially collapse, while a second portion of the gap 41 can completely collapse. The amount and/or location of gap 41 collapse can depend on various factors, including, but not limited to, the golf ball impact location on the face 122 (e.g., towards the toe 114, towards the heel 116, towards the top rail 118, towards the sole 120, at the "sweet spot," etc.), the swing speed of the golfer, etc.

Once the gap 41 has collapsed, the insert 50 can partially deform to further increase deformation or deflection of the face 122. Once the insert 50 can no longer deform, deformation of the face 122 ceases. The amount the insert 50 is able to deform directly correlates with the spring constant of the insert 50. Therefore, as discussed above, the maximum amount of deformation can be adjusted by changing the material or geometry of the insert 50. Once the gap 41 has collapsed, the insert 50 can support the face plate 122 from further deformation or deflection to reduce the risk of reaching irreversible plastic deformation. The face 122 and insert 50 then rebound to their respective pre-impact positions (i.e., the gap 41 reforms), generating a desired spring-like effect that results in an increased golf ball speed and an increased golf ball travel distance.

b. Deflection Feature Comprising Insert with Voids

FIGS. 6-15 illustrate various embodiments of an insert having a plurality of voids. The inserts of FIGS. 6-15 are similar to insert 50, except the inserts of FIGS. 6-15 can be devoid of a gap. The inserts of FIGS. 6-15 comprise a front surface opposite a rear surface, a top surface opposite a bottom surface, and a toe end opposite the heel end. Further, inserts of FIGS. 6-15 can comprise a plurality of voids. The plurality of voids can function similarly to the gap 41 of insert 50. Specifically, the plurality of voids can lower the spring constant or effective elastic modulus of the insert, allowing the insert 150 to deform such that it does not inhibit, or minimally inhibits, the deformation of the face at impact. Increasing the deformation of the insert, as a result of the voids, allows the face 22 to deflect more and transfer more energy back to a golf ball on impact, thereby increasing ball speed and travel distance, compared to a club head having a solid insert without voids.

The insert having a plurality of voids comprises a void ratio defined as a ratio between the volume of voided space to the volume of solid space within the insert. Increasing the volume of voids within the insert increases the void ratio and lowers the spring constant or effective elastic modulus of the insert. In many embodiments, the insert with a plurality of voids can comprise a void ratio up to 0.20, up to 0.30, up to 0.40, up to 0.50, up to 0.60, up to 0.70, up to 0.80, or up to 0.90. In other embodiments, the insert can comprise a void ratio between 0.05 and 0.80, between 0.10 and 0.60, between 0.05 and 0.60, or between 0.10 and 0.60.

Figure 6:
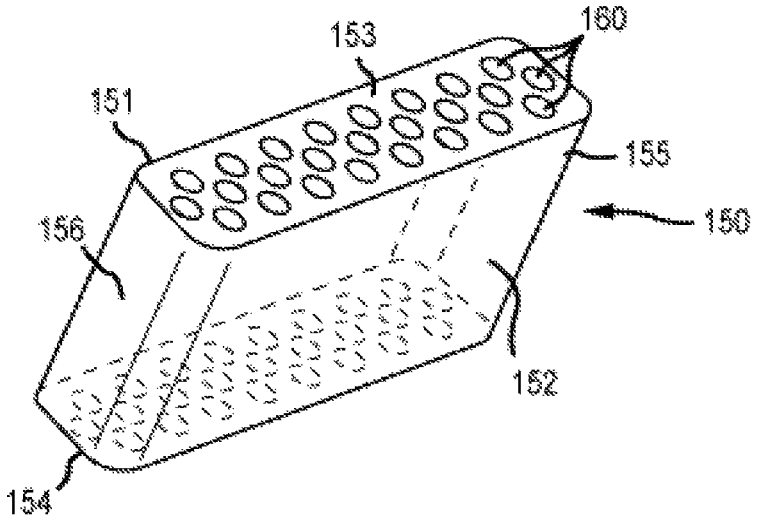
FIG. 6 is a perspective view of an insert according to another embodiment.
Figure 7:
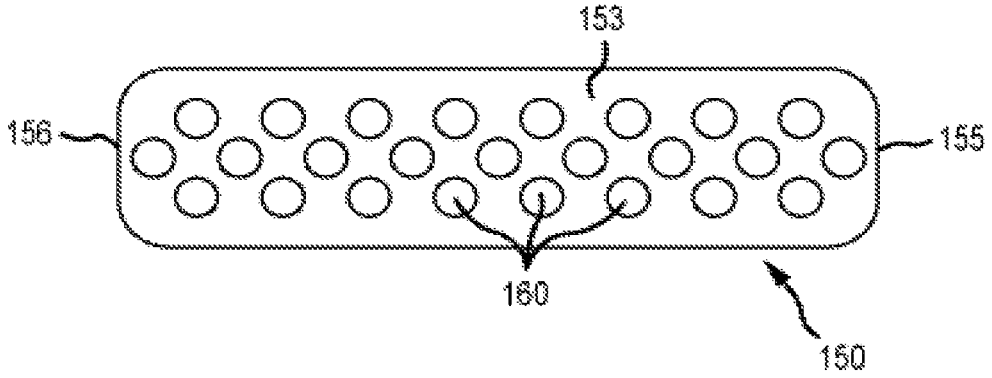
FIG. 7 is a top view of the insert of FIG. 6.
Figure 8:
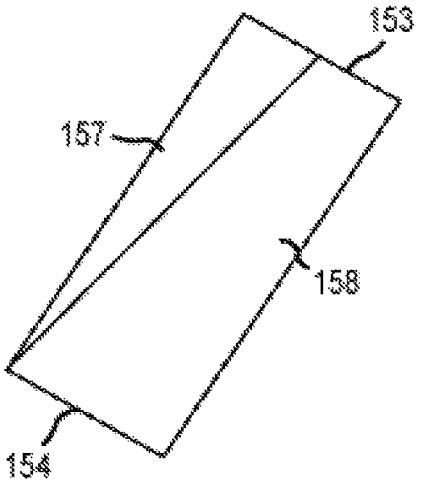
FIG. 8 is a side view of the insert from FIG. 6.

Referring to FIGS. 6 and 7, an embodiment of an insert 150 having a plurality of voids is illustrated. In the illustrated embodiment, the plurality of voids 160 extend in a direction from the top surface 153 to the bottom surface 154 of the insert 150.

Referring to FIG. 7, each void 160 of the plurality of voids 160 has a circular cross section, which extends through the entirety of the insert 150 (from the top surface 153 to the bottom surface 154). The voids 160 are placed in a uniform pattern, wherein each void 160 is spaced uniformly from each void 160 adjacent to it. The voids 160 can be grouped into rows extending from the toe end 155 to the heel end 156 of the insert 150. The insert 150 can comprise multiple rows extending from near the front surface 151 to near the rear surface 152. In some embodiments, each row can have a uniform spacing from the row before and/or after it. In other embodiments, the distance between each row can increase, decrease or remain constant from front surface 151 to the rear surface 152 of the insert 150. In other embodiments, the distance between a row of voids 160 and an adjacent row of voids 160 can vary from the toe end 155 to the heel end 156. For example, the spacing between the rows of voids 160 near the toe and heel end 155, 156 can be greater or less than near the center of the insert 150. In other embodiments, the spacing between the rows of voids 160 can be greater or less near the toe end 156 of the insert 150 than near the heel end 155 of the insert 150. Further, in the illustrated embodiment, each row is offset from the row adjacent to it. In other embodiments, the rows can be positioned in any orientation with respect to the adjacent rows.

Referring again to FIGS. 6 and 7, in the illustrated embodiment, each void 160 is spaced a uniform distance from adjacent voids 160 within the same row. In other embodiments, the distance between adjacent voids 160 within the same row can increase, decrease or remain constant from the toe end 155 to the heel end 156. In some embodiments, the distance between adjacent voids 160 within the same row can be between 0.005 to 0.5 inches. In other embodiments, each void 160 within the same row can be spaced apart by a distance within the range of 0.005 to 0.01, 0.01 to 0.05, 0.05 to 0.1, 0.1 to 0.15, 0.15 to 0.2, 0.2 to 0.25, 0.25 to 0.3, 0.3 to 0.35, 0.35 to 0.4, 0.4 to 0.45, or 0.45 to 0.5 inches.

Referring again to FIGS. 6 and 7, in the illustrated embodiment, each void 160 of the plurality of voids 160 has the same size and shape. In some embodiments, the size of the voids 160 can increase, decrease or remain constant from the toe end 155 to the heel end 156 of the insert 150. For example, in some embodiments, the size of the voids 160 can be greatest in the center of the insert 150, and can decrease in a direction toward the toe end 155 and the heel end 156 of the insert 150. In other embodiments, the size of the voids 160 can increase, decrease or remain constant from the front surface 151 to the rear surface 152 of the insert 150. For example, the size of the voids 160 can be greatest near the front surface 151 and decrease in a direction toward the rear surface 152 of the insert 150.

The voids 160 can comprise any shape. For example, the voids 160 can have a triangular, rectangular, polygonal or any other suitable shape cross-section. In some embodiments, the insert 150 can comprise a plurality of voids 160 having two different cross sections. For example, the voids 160 near the front surface 151 of the insert can have a circular cross-section and the voids 160 near the rear surface 152 can have a triangular cross-section. In other embodiments, the insert 150 can comprise a plurality of voids 160 having up to 6 different cross-sectional shapes, positioned in any pattern on the insert 150.

In some embodiments, the insert 150 (the volume defined between the front surface 151, rear surface 152, top surface 153, bottom surface 154, toe end 155, and heel end 156) can comprise 50% voids 160. In other embodiments, the insert can comprise between 5% and 80% voids. For example, in some embodiments, the insert 150 can comprise 5%, 7.5%, 10%, 12.5%, 15%, 17.5%, 20%, 22.5%, 25%, 27.5%, 30%, 32.5%, 35%, 37.5%, 40%, 42.5%, 45%, 47.5%, 50%, 52.5%, 55%, 57.5%, 60%, 62.5%, 65%, 67.5%, 70%, 72.5%, 75%, 77.5%, or 80% voids 160.

Having a higher concentration of voids 160 within the insert 150 lowers the spring constant or effective elastic modulus of the insert on impact with a golf ball, resulting in less energy being absorbed by the insert 150 at impact. However, a higher concentration of voids 160 within the insert 150 also removes weight from the insert 150 and can affect how the insert 150 functions as a swing weight. Generally, it is beneficial to have a greater portion of the mass distributed towards the sole and rear end of the golf club head. Therefore, in some embodiments, referring to FIG. 8, the insert 150 can have a high concentration of voids 160 in a first portion 157 towards the front surface 151 of the insert 150, and have a low concentration of voids 160 in a second portion 158 towards the rear surface 152 of the insert 150. As such, the first portion 157 of the insert 150 near the face of the golf club head has a low spring constant and will not inhibit deflection of the face, while the second portion 158 of the insert 150 near the rear end of the club head can have a higher mass to function as a swing weight. In the illustrated embodiment, the first portion 157 comprising the higher concentration of voids 160 is larger near the top surface 153 and tapers towards the front surface 151 as it extends towards the bottom surface 154 of the insert 150. In other embodiments, the first portion 157 can increase or remain the same as it extends towards the bottom surface 154 of the insert 150.

In some embodiments, the first portion 157 can comprise 50% percent of the insert 150. In other embodiments, the first portion 157 can comprise at least 15% of the insert 150. For example, the first portion 157 can comprise greater 15%, 20%, 25%, 30%, 35%, 40%, 45%, 50%, 55%, 60%, 65%, 70% or 75% of the insert 150. Further, the first portion 157 can comprise greater than 10% voids 160, while the second portion can comprise less that 75% voids 160. For example, the first portion 157 of the insert 150 can comprise greater than 10%, 15%, 20%, 25%, 30%, 35%, 40%, 45%, 50%, 55%, 60%, 65%, 70% or 75% voids 160, while the second portion 158 of the insert 150 can comprise less than 75%, 70%, 65%, 60%, 55%, 50%, 45%, 40%, 35%, 30%, 25%, 20%, 15%, or 10% voids 160.

In some embodiments, the first portion 157 can comprise the same material as the second portion 158. In other embodiments, the first portion 157 can comprise a different material than the second portion 158. For example, in some embodiments, the first portion 157 can comprise a material having a lower density resulting in a lower spring constant, while the second portion 158 can comprise a material having a higher density to better function as a swing weight. In other embodiments, the insert 150 can comprise up to 4 different portions, comprising different concentrations of voids 160 or materials.

Figure 9:
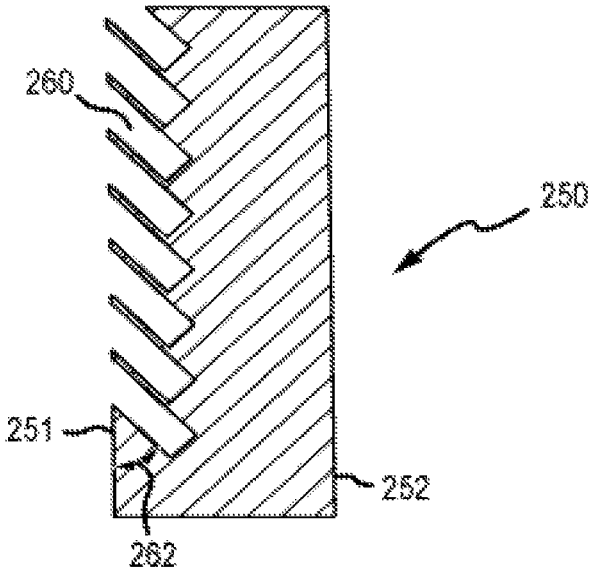
FIG. 9 is a side view of an insert according to another embodiment.
Figure 15:
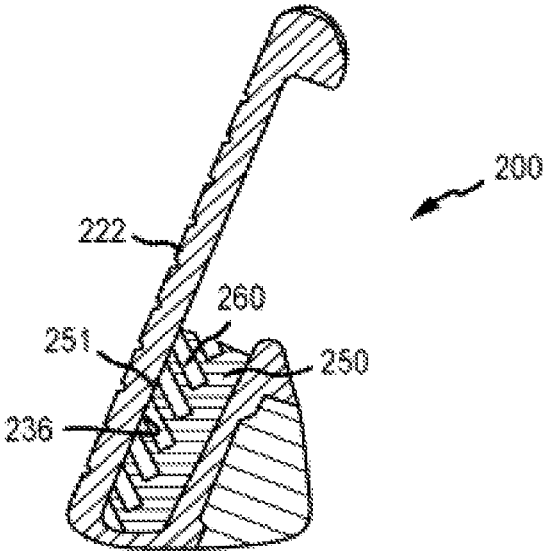
FIG. 15 is a cross-sectional view of a golf club head comprising the insert from FIG. 9.

Referring to FIGS. 9 and 15, another embodiment of an insert 250 is displayed. The insert 250 is similar to the insert 150 and can comprise the same variations as described above, except the voids 260 of insert 250 extend inward from the front surface 251 of the insert 250 toward the bottom surface of the insert 250. Further, the voids 260 form a void angle 262, defined between the bottom edge of the void 260 and the front surface 251 of the insert 250. In the illustrated embodiment, the voids 260 form an acute void angle 262. In other embodiments, the voids 260 can extent from the front surface toward the back surface or toward the top surface of the insert 250. Further, in some embodiments, the void angle 262 can be obtuse angle or can be 90 degrees with the front surface 251. Further, as mentioned above, the voids 260 can vary in size, shape, concentration, position and/or any other parameter described above in relation to voids 160.

In some embodiments, each void 260 of FIGS. 9 and 15 can extend from the heel end to the toe end of the insert 250. In other embodiments, multiple voids 260 having any cross sectional geometry can positioned between the heel end and toe end of the insert.

Referring to FIG. 15, insert 250 comprising voids 260 is shown in relation to golf club head 200. The club head 200 is similar to club head 10 and 100, except it comprises insert 250 having a plurality of voids 260 as the deflection feature. The front surface 251 of the insert 250 is positioned adjacent to the face interior surface 236 of the cavity 230. The rear surface 252 of the insert 250 is positioned adjacent to the rear end interior surface 232 of the cavity 230. The bottom surface 254 of the insert 250 is positioned adjacent to the sole interior surface 234 of the cavity 230.

In the illustrated embodiment, the voids 260 contact or extend to the face interior surface 236 of the golf club head 200. The voids 260 are positioned at a void angle 262 (defined above), such that, at impact, the face 222 deflects, causing portions of the insert 250 on either side of the void 260 to deflect inward, collapsing the voids 260. In many embodiments, the concentration of voids 260 contacting the face interior surface 236 is large enough that the spring constant of the insert 250 is substantially zero or is negligible. Therefore, the insert 250 absorbs minimal amounts of energy from the impact with the golf ball, and the face 222 is able to deflect and rebound fully, resulting in the face 222 transferring a majority of the energy from impact back to the golf ball.

For example, in some embodiments, the percentage of surface area of the front surface of the insert 250 comprising voids 260 can be between 5% and 80%. In other embodiments, the percentage of surface area of the front surface of the insert 250 comprising voids 260 can be 5%, 7.5%, 10%, 12.5%, 15%, 17.5%, 20%, 22.5%, 25%, 27.5%, 30%, 32.5%, 35%, 37.5%, 40%, 42.5%, 45%, 47.5%, 50%, 52.5%, 55%, 57.5%, 60%, 62.5%, 65%, 67.5%, 70%, 72.5%, 75%, 77.5%, or 80%.

In embodiments where the concentration of voids 260 contacting or extending to the front surface of the insert against the face interior surface 236 is lower, the insert 250 can compress and absorb some energy from impact and then release the energy back into the face 222 by a spring back force. For example, the portion of the insert 250 on either side of the voids 260 can deflect at impact until the spring constant is too great for the force of impact to further deflect the insert 250. At this point, the face 222 and the insert 250 will cease to deflect rearward, however, the energy from impact will be stored in the portions of the insert 250, which were deflected. The insert 250 can then rebound back to its original position redistributing the energy to the face 222.

Figure 10:
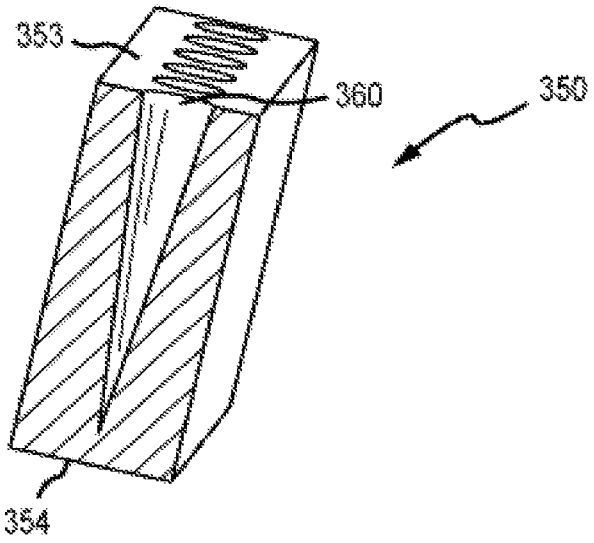
FIG. 10 is a cross-sectional side view of an insert according to another embodiment.
Figure 11:
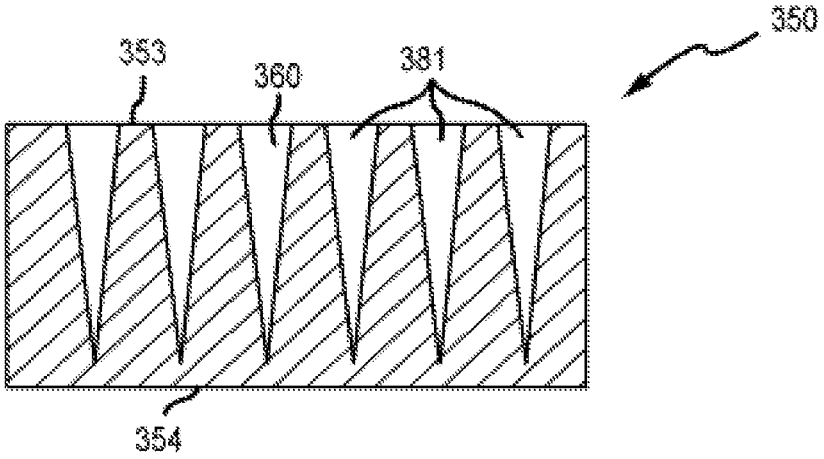
FIG. 11 is a cross-sectional front view of the insert from FIG. 10.

Referring to FIG. 10, another embodiment of an insert 350 is shown. The insert 350 is similar to inserts 150 and 250 and can comprise the same variations as described above, except the voids 360 do not have a constant cross-section. The insert 350 can comprise a greater concentration of voids 360 near the top surface 353 than near the bottom surface 354. In the illustrated embodiment, the voids 360 comprise a conic shape, wherein the cross-section has a circular shape across the entire length (extending in a direction from the top surface 153 to bottom surface 154) of the void 360. However, the diameter of the circular cross-section decreases as the void 360 extends from the top surface 353 to the bottom surface 354. Referring to FIG. 11, this creates an insert 350 having a higher concentration of voided area 381 (area comprising only air) near the top surface 353 than near the bottom surface 354 of the insert 350. The voids 360 have gradually tapered edges, wherein the void 360 terminates prior to the bottom surface 354. In some embodiments, the voids 360 can have cross-sections (not shown), which have abrupt steps from one diameter to the next. Further, in some embodiments, the voids 360 can have a concentration that decreases from the top surface 353 to the bottom surface 354, but still extends through the bottom surface of the insert 354.

Figure 13:
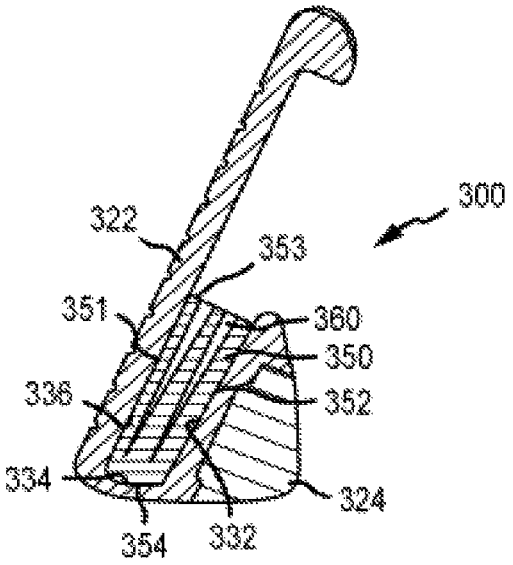
FIG. 13 is a cross-sectional view of a golf club head comprising the insert from FIG. 10.

FIG. 13 illustrates the insert 350 having a plurality of voids 360 in relation to a golf club head 300. The golf club head 300 is similar to the golf club heads 10, 100 and 200, except it comprises insert 350 having a plurality of voids 360 as the deflection feature. The front surface 351 of the insert 350 is positioned adjacent to the face interior surface 336 of the cavity 330. The rear surface 352 of the insert 350 is positioned adjacent to the rear end interior surface 332 of the cavity 330. The bottom surface 354 of the insert 350 is positioned adjacent to the sole interior surface 334 of the cavity 330.

During impact with a golf ball, the face 322 of the club head 300 having the insert 350 undergoes deformation or deflection. The face plate 322 deforms or deflects in a direction generally towards the rear end 324. The face plate 322 has the greatest deformation near the center of the face 322, wherein the highest concentration of voided area exists. At impact, the voids 360 within the insert 350 collapse, allowing the face 322 to deflect with minimal to no inhibition from the insert 350. In the illustrated embodiment, the insert 350 comprises conic shaped voids 360, which are largest near the top surface 330 and which decrease as they extend towards the bottom surface 354. The top surface 353 of the insert 350 is positioned adjacent to the center of the face 322, which exhibits the greatest deflection on impact with a golf ball. As such, the portion of the insert 350 near the top surface 353 has a higher concentration of voids 360 maintain the maximum face 322 deflection. In many embodiments, the percentage of voided area in the portion of the insert 350 near the center of the face 322 is large enough that the spring constant of the insert 350 is essentially zero. As such, the insert 350 absorbs minimal amounts of energy from the impact with the golf ball, and the face 322 is able to deflect and rebound fully, resulting in the face 322 transferring a majority of the energy from impact back to the golf ball. For example, in some embodiments, the percentage of voided area (volume of voids 360 compared to volume of insert 350 material) in the portion of the insert 350 near the center of the face 322 can be between 5% and 80%. In other embodiments, the percentage of voided area in the portion of the insert 350 near the center of the face 322 can be 5%, 7.5%, 10%, 12.5%, 15%, 17.5%, 20%, 22.5%, 25%, 27.5%, 30%, 32.5%, 35%, 37.5%, 40%, 42.5%, 45%, 47.5%, 50%, 52.5%, 55%, 57.5%, 60%, 62.5%, 65%, 67.5%, 70%, 72.5%, 75%, 77.5%, or 80%. In these or other embodiments, the center of the face can comprise the central one third of the length of the face extending from the heel end 16 to the toe end 18, and/or can comprise the central one third of the height of the face extending from the top rail 18 to the sole 20.

The lower portion of the front surface 351 near the bottom surface 354 of the insert 350 has a lower concentration of voids 360. The lower portion of the insert 350 is positioned adjacent to a bottom portion of the face 322, wherein the face 322 has minimal deflection. As such, the lower portion of the front surface 351 is able to damp vibrations caused by the impact, without inhibiting face 322 deflection or absorbing large amounts of energy. The result is a golf club head 300 comprising an insert 350, wherein the insert 350 damps vibration to achieve desired impact acoustics, while not inhibiting face 322 deflection. Further, the insert 350 comprising a higher concentration of voids 360 near the top surface 353, resulting in a majority of its mass distributed towards the bottom surfaces 354. Therefore, the insert 350 can also be utilized as a swing weight aiding to move the club head 300 CG low and back.

Figure 12:
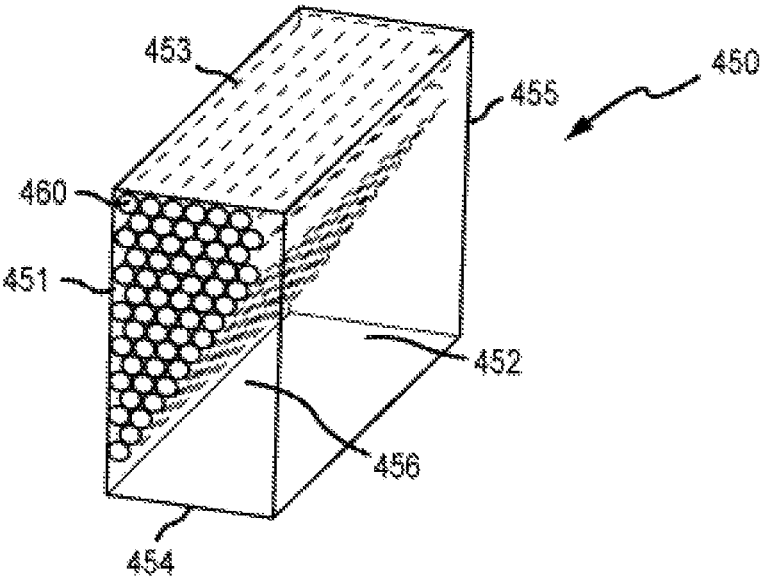
FIG. 12 is a perspective view of an insert according to another insert.

Referring to FIG. 12, another embodiment of an insert 450 comprising voids 460 is displayed. The insert 450 is similar to inserts 150, 250, and 350 and can comprise the same variations as described above, except the voids 460 extend from the heel end 456 to the toe end 455. In the illustrated embodiment, the cross-sectional shape of the void 460 is hexagonal. In other embodiments, the cross-sectional shape can be circular, triangular, rectangular, or any other suitable shape. Further, the cross-sectional shape of the voids 460 can remain constant or can change across the length of the insert 450. Further, the cross-sectional area of the voids 460 can increase, decrease or remain constant from the heel end 456 to the toe end 455. As discussed above, the insert 450 can comprise a higher concentration of voids 460 near the top surface 453 than near the bottom surface 454. The insert 450 can also vary according to any of the parameters described above with regards to inserts 50, 150, 250, 350.

Figure 14:
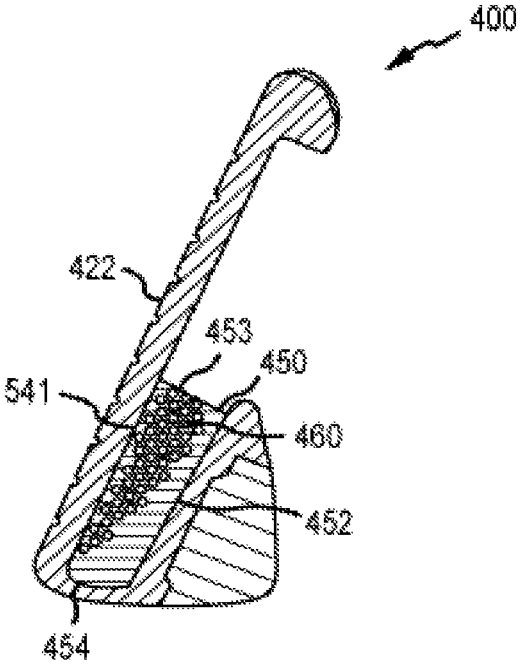
FIG. 14 is a cross-sectional view of a golf club head comprising the insert from FIG. 12.

Referring to FIG. 14, insert 450 is shown in relation to a golf club head 400. Golf club head 400 is similar to club head 10, 100, 200, and 300, except it comprises insert 450 having a plurality of voids 460 as the deflection feature. In the illustrated embodiment, the concentration of voids 460 can be greater near the front surface 451 than near the rear surface 452 of the insert 450. Therefore, the spring constant or effective modulus can change across the depth (front surface 451 to rear surface 452) of the insert 450. In these or other embodiments, during impact, the face 422 continues to deform or deflect until the spring constant of the insert 450 becomes too great.

Once the spring constant has reached a value wherein the force of impact can no longer compress the insert 450, deformation of the face 422 ceases. The amount the insert 450 is able to deform directly correlates with the spring constant or effective modulus of the insert 450. Therefore, altering the inserts 450 spring constant or effective modulus can alter the maximum face 422 deflection. As discussed above, the spring constant or effective modulus of the insert 450 can be altered by changing the material or geometry of the insert 450. At the point of maximum deformation, the insert 450 can support the face plate 422 from further deformation or deflection to reduce the risk of reaching irreversible plastic deformation. The face 422 and insert 450 then rebound to their respective pre-impact positions, generating a desired spring-like effect, which can result in an increased golf ball speed and an increased golf ball travel distance.

II) Deflection Feature Comprising a Thinned Sole

Figure 16:
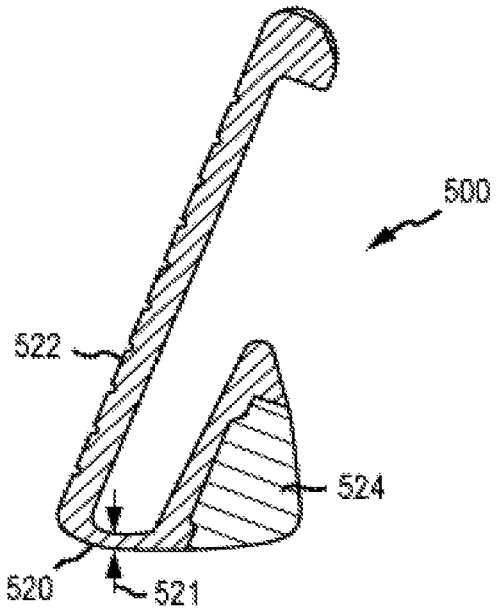
FIG. 16 is a cross-sectional view of a golf club head having a thin uniform sole.

As discussed above, the deflection feature of the golf club head 10 can further be a thin uniform sole. In some embodiments, the thinned uniform sole can be combined with one or more of the deflection features of the golf club head 10, 100, 200, 300, and 400 discussed above. FIG. 16 illustrates a golf club head 500 comprising a thin uniform sole 520. The golf club head 500 is similar to the golf club heads 10, 100, 200, 300, 400, except it comprises a thin uniform sole 520 as the deflection feature. The thin uniform sole 520 can extend from the face 522 to the rear end 524.

The thin uniform sole 520 can provide multiple benefits. First, the thin uniform sole 520 can reduce stress on the face 522 caused during impact with the golf ball. Second, the thin uniform sole 520 can bend allowing the face 522 to experience greater deflection. Third, the thin uniform sole 520 removes weight from the sole area, allowing the weight to be redistributed in the rear end 524 of the golf club head 500. At impact, the energy imparted to the face 522 by the golf ball can cause the thin uniform sole 520 to bend outward, which in turn increases the face 522 deflection. After bending, the thin uniform sole 520 rebounds back to its original position returning the majority of the energy from impact back to the golf ball. The result is a golf club head 500, which imparts increased ball speeds and greater travel distances to the golf ball after impact. As a comparative, a club head without a thin uniform sole may have a sole thickness ranging from approximately 0.90 inches to approximately 1.5 inches.

In the illustrated embodiment, the thin uniform sole 520 comprises a sole thickness 521, which remains constant from the face 522 to the rear end 524. The shape of the sole 520 can follow the 3-dimensional contour of the outer surface of the sole 520. The uniform thin sole 520 also comprises a sole thickness 521, which can be thinner than a conventional sole. For example, in some embodiments, the sole thickness 521 may range from approximately 0.15-0.85 inches. In other embodiments, the sole thickness 521 may be within the range of 0.15-0.35, 0.25-0.45, 0.35-0.55, 0.45-0.65, 0.55-0.75, or 0.65-0.85 inches. In other embodiments, the sole thickness may be approximately 0.15, 0.20, 0.25, 0.30, 0.35 0.40, 0.45, 0.50, 0.55, 0.60, 0.65, 0.70, 0.75, 0.80, or 0.85 inches.

Further, the thin uniform sole 520 can also be described as having a spring constant. Similar to inserts 50, 150,250, 350, 450, the spring constant of the sole 520 can be calculated using Hookes law (defined above). To adjust the spring constant of the sole 520, the material or sole thickness 521 can be adjusted. Having a thinner sole 520 results in a lower spring constant, which allows for greater bending of the sole 520 and thus, greater deflection in the face 522, resulting in increased energy transfer back to a golf ball on impact due to a greater spring back force. In some embodiments, the sole 520 of the club head 500 can include a cascading region of thinning tiers, similar to the cascading sole described in U.S. patent application Ser. No. 14/920,480 entitled "Golf Club Heads with Energy Storage Characteristics."

III) Deflection Feature Comprising a Cutout in Top Rail

Figure 17:
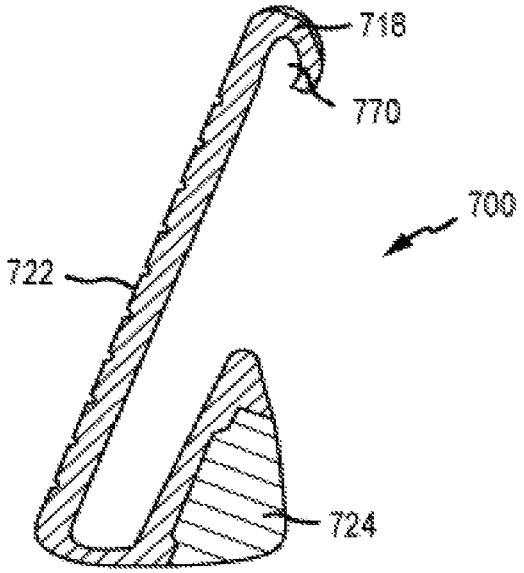
FIG. 17 is a cross-sectional view of a golf club head having a cutout in the top rail.

As discussed above, the deflection feature of the golf club head 10 can be a cavity or undercut or cutout (hereafter cutout) in the top rail. FIG. 17 illustrates the golf club head 700 comprising a cutout 770 in the top rail 718 adjacent to the rear surface of the face 722. The golf club head 700 is similar to the golf club heads 10, 100, 200, 300, 400, and 500, except the golf club head 700 comprises a cutout 770 in the top rail 718 as the deflection feature. In some embodiments, the cutout 770 can be combined with one or more of the deflection features of the golf club head 10, 100, 200, 300, 400, and 500 discussed above.

The cutout 770 can provide multiple benefits. First, the cutout 770 can increase face 722 deflection by lengthening the area across which the stress from impact is distributed. Second, the cutout 770 can increase flexibility in the top rail 718 of the golf club head 700. Third, the cutout 770 can remove weight from the top rail 718, allowing it to be redistributed in the lower rear end 724 of the golf club head 700.

At impact, the energy imparted to the face 722 by the golf ball causes the face 722 to deflect. The cutout 770 can increase deflection in the face 722 by lowering the face 722 spring constant. Similar to inserts 50, 150, 25, 350, 450 or the uniform thin sole 520, the spring constant of the face 722 can be calculated using Hookes law (defined above). The cutout 770 can adjust the spring constant of the face 722 by lengthening the area across which the stress from impact is spread. Having a longer area to absorb the stress, results in a lower spring constant. Having a face 722 with a lower spring constant creates a face 722 with greater deflection at the point of impact.

IV) Deflection Feature Comprising Optimized Face Materials

As discussed above, the deflection feature of the golf club head 10 can be a face comprising optimized materials. In some embodiments, the optimized material can be combined with one or more of the deflection features of the golf club head 10, 100, 200, 300, 400, 500, and 700 discussed above.

The face 22 can be comprised solely of the optimized face material (not shown) or the face 22 can be comprised partially of the optimized face material and partially of a conventional face material. The optimized face material includes a strength-to-weight ratio or specific strength measured as the ratio of the yield strength to the density of the material. The optimized face material further includes a strength-to-modulus ratio or specific flexibility measured as the ratio of the yield strength to the elastic modulus of the material.

The optimized face material can have a specific strength greater than the specific strength of current known club head materials, while also having a reduced weight compared to a similar club head with known materials. Having an increased specific strength allows for a thinner face 22, which can increase face 22 deflection. The reduced weight of the optimized face material can also allow the weight to be redistributed to the rear end 24 of the club head 10. Further, the optimized face material can have a specific flexibility greater than the specific flexibility of current club head face materials. The face 22 having increased flexibility can reduce energy loss on impact with a golf ball, thereby increasing energy transfer to the ball resulting in increased ball speed and travel distance.

In some embodiments, the optimized face material can be a steel alloy having a specific strength of greater than or equal to 500,000 PSI/lb/in$^3$ (125 MPa/g/cm$^3$). For example, the specific strength of the steel alloy can be greater than or equal to 510,000 PSI/lb/in$^3$ (127 MPa/g/cm$^3$), greater than or equal to 520,000 PSI/lb/in$^3$ (130 MPa/g/cm$^3$), greater than or equal to 530,000 PSI/lb/in$^3$ (132 MPa/g/cm$^3$), greater than or equal to 540,000 PSI/lb/in$^3$ (135 MPa/g/cm$^3$), greater than or equal to 550,000 PSI/lb/in$^3$ (137 MPa/g/cm$^3$), greater than or equal to 560,000 PSI/lb/in$^3$ (139 MPa/g/cm$^3$), greater than or equal to 570,000 PSI/lb/in$^3$ (142 MPa/g/cm$^3$), greater than or equal to 580,000 PSI/lb/in$^3$ (144 MPa/g/cm$^3$), greater than or equal to 590,000 PSI/lb/in$^3$ (147 MPa/g/cm$^3$), greater than or equal to 600,000 PSI/lb/in$^3$ (149 MPa/g/cm$^3$), greater than or equal to 625,000 PSI/lb/in$^3$ (156 MPa/g/cm$^3$), greater than or equal to 675,000 PSI/lb/in$^3$ (168 MPa/g/cm$^3$), greater than or equal to 725,000 PSI/lb/in$^3$ (181 MPa/g/cm$^3$), greater than or equal to 775,000 PSI/lb/in$^3$ (193 MPa/g/cm$^3$), greater than or equal to 825,000 PSI/lb/in$^3$ (205 MPa/g/cm$^3$), greater than or equal to 875,000 PSI/lb/in$^3$ (218 MPa/g/cm$^3$), greater than or equal to 925,000 PSI/lb/in$^3$ (230 MPa/g/cm$^3$), or greater than or equal to 975,000 PSI/lb/in$^3$ (243 MPa/g/cm$^3$).

For further example, the specific strength of the steel alloy can be between 510,000 PSI/lb/in$^3$ (127 MPa/g/cm$^3$) and 975,000 PSI/lb/in$^3$ (243 MPa/g/cm$^3$), between 530,000 PSI/lb/in$^3$ (132 MPa/g/cm$^3$) and 975,000 PSI/lb/in$^3$ (243 MPa/g/cm$^3$), between 550,000 PSI/lb/in$^3$ (137 MPa/g/cm$^3$) and 975,000 PSI/lb/in$^3$ (243 MPa/g/cm$^3$), between 570,000 PSI/lb/in$^3$ (142 MPa/g/cm$^3$) and 975,000 PSI/lb/in$^3$ (243 MPa/g/cm$^3$), between 590,000 PSI/lb/in$^3$ (147 MPa/g/cm$^3$) and 975,000 PSI/lb/in$^3$ (243 MPa/g/cm$^3$), between 625,000 PSI/lb/in$^3$ (156 MPa/g/cm$^3$) and 975,000 PSI/lb/in$^3$ (243 MPa/g/cm$^3$), between 675,000 PSI/lb/in$^3$ (168 MPa/g/cm$^3$) and 975,000 PSI/lb/in$^3$ (243 MPa/g/cm$^3$), between 725,000 PSI/lb/in$^3$ (181 MPa/g/cm$^3$) and 975,000 PSI/lb/in$^3$ (243 MPa/g/cm$^3$), between 775,000 PSI/lb/in$^3$ (193 MPa/g/cm$^3$) and 975,000 PSI/lb/in$^3$ (243 MPa/g/cm$^3$), or between 825,000 PSI/lb/in$^3$ (205 MPa/g/cm$^3$) and 975,000 PSI/lb/in$^3$ (243 MPa/g/cm$^3$).

Further, the specific flexibility of the steel alloy can be greater than or equal to 0.0060. For example, the specific flexibility of the steel alloy can be greater than or equal to 0.0062, greater than or equal to 0.0064, greater than or equal to 0.0066, greater than or equal to 0.0068, greater than or equal to 0.0070, greater than or equal to 0.0072, greater than or equal to 0.0076, greater than or equal to 0.0080, greater than or equal to 0.0084, greater than or equal to 0.0088, greater than or equal to 0.0092, greater than or equal to 0.0096, greater than or equal to 0.0100, greater than or equal to 0.0104, greater than or equal to 0.0108, greater than or equal to 0.0112, greater than or equal to 0.0116, greater than or equal to 0.0120, greater than or equal to 0.0125, greater than or equal to 0.0130, greater than or equal to 0.0135, or greater than or equal to 0.0140.

For further example, the specific flexibility of the steel alloy can be between 0.0060 and 0.0140, between 0.0062 and 0.0120, between 0.0064 and 0.0120, between 0.0066 and 0.0120, between 0.0068 and 0.0120, between 0.0070 and 0.0120, between 0.0080 and 0.0120, between 0.0088 and 0.0120, or between 0.0096 and 0.0120.

In some embodiments, the elongation of the steel alloy can be greater than 8%, greater than 9%, greater than 10%, greater than 11%, greater than 12%, greater than 13%, greater than 14%, or greater than 15% to allow plastic deformation of the body to achieve bending for a desired loft and/or lie angle of the club head 10.

In embodiments, wherein the optimized face material is a steel alloy, the yield strength of the steel alloy can be greater than or equal to 170,000 PSI (1172 MPa), greater than or equal to 175,000 PSI (1207 MPa), greater than or equal to 180,000 PSI (1241 MPa), greater than or equal to 185,000 PSI (1276 MPa), greater than or equal to 190,000 PSI (1310 MPa), greater than or equal to 195,000 PSI (1344 MPa), greater than or equal to 200,000 PSI (1379 MPa), greater than or equal to 225,000 PSI (1551 MPa), or greater than or equal to 250,000 PSI (1724 MPa). Further, the yield strength of the steel alloy can be between 170,000 PSI (1172 MPa) and 250,000 PSI (1724 MPa), between 175,000 PSI (1207 MPa) and 250,000 PSI (1724 MPa), between 180,000 PSI (1241 MPa) and 250,000 PSI (1724 MPa), between 190,000 PSI (1310 MPa) and 250,000 PSI (1724 MPa), or between 200,000 PSI (1379 MPa) and 250,000 PSI (1724 MPa).

Further, the elastic modulus of the steel alloy can be less than or equal to 35,000,000 PSI (241,317 MPa), less than or equal to 32,500,000 PSI (224,080 MPa), less than or equal to 30,000,000 PSI (206,843 MPa), less than or equal to 28,000,000 PSI (193,053 MPa), less than or equal to 27,500,000 PSI (189,606 MPa), less than or equal to 27,000,000 PSI (186,159 MPa), less than or equal to 26,500,000 PSI (182,711 MPa), less than or equal to 26,000,000 PSI (179,264 MPa), less than or equal to 25,500,000 PSI (175,816 MPa), or less than or equal to 25,000,000 PSI (172,369 MPa). Further, the elastic modulus of the steel alloy can be between 25,000,000 PSI (172,369 MPa) and 35,000,000 PSI (241,317 MPa), between 25,000,000 PSI (172,369 MPa) and 30,000,000 PSI (206,843 MPa), or between 25,000,000 PSI (172,369 MPa) and 27,000,000 PSI (186,159 MPa).

Additionally, the density of the steel alloy can be less than or equal to 0.40 lb/in$^3$ (11.0 g/cm$^3$), less than or equal to 0.35 lb/in$^3$ (9.7 g/cm$^3$), less than or equal to 0.30 lb/in$^3$ (8.3 g/cm$^3$), less than or equal to 0.29 lb/in$^3$ (8.0 g/cm$^3$), less than or equal to 0.28 lb/in$^3$ (7.8 g/cm$^3$), less than or equal to 0.27 lb/in$^3$ (7.5 g/cm$^3$), less than or equal to 0.26 lb/in$^3$ (7.2 g/cm$^3$), or less than or equal to 0.25 lb/in$^3$ (6.9 g/cm$^3$). Further, the density of the steel alloy can be between 0.25 lb/in$^3$ (6.9 g/cm$^3$) and 0.40 lb/in$^3$ (11.0 g/cm$^3$), between 0.25 lb/in$^3$ (6.9 g/cm$^3$) and 0.35 lb/in$^3$ (9.7 g/cm$^3$), between 0.25 lb/in$^3$ (6.9 g/cm$^3$) and 0.30 lb/in$^3$ (8.3 g/cm$^3$), or between 0.25 lb/in$^3$ (6.9 g/cm$^3$) and 0.28 lb/in$^3$ (7.8 g/cm$^3$).

V) Deflection Feature Comprising Reinforcement Device

FIGS. 20-28 illustrate a golf club head 1000 having a deflection feature comprising a reinforcement device 1112. The reinforcement device 1112 can be used to reinforce a thin face, thereby allowing increased face deflection and increased energy transfer to a golf ball (resulting in increased ball speed and travel distance). In some embodiments, the golf club head 1000 can further include one or more deflection feature of the golf club head 10, 100, 200, 300, 400, 500, and 700 discussed above, including an insert, a thin uniform sole, or an optimized material and/or thin face.

Club head 1000 comprises an x-axis 1107, a y-axis 1108, and a z-axis 1109. X-axis 1107, y-axis 1108, and z-axis 1109 provide a Cartesian reference frame for club head 1000. Accordingly, x-axis 1107, y-axis 1108, and z-axis 1109 are perpendicular to each other. Further, x-axis 1107 extends through toe end 1104 and heel end 1106 and is equidistant between top end 1018 and bottom end 1020; y-axis 1108 extends through top end 1018 and bottom end 1020 and is equidistant between toe end 1104 and heel end 1106; and z-axis 1109 extends through front end 1203 (FIG. 21) and rear end 1104 and is equidistant (i) between toe end 1104 and heel end 1106 and (ii) between top end 1018 and bottom end 1020. In these or other embodiments, club head 1000 comprises a club head body 1012.

Club head body 1012 can be solid, hollow, or partially hollow. When club head body 1012 is hollow and/or partially hollow, club head body 1012 can comprise a shell structure, and further, can be filled and/or partially filled with a filler material different from a material of shell structure. For example, the filler material can comprise a plastic foam.

Club head body 1012 comprises a face or face element 1022 and a reinforcement device 1112. In many embodiments, club head body 1012 can comprise a perimeter wall element 1113.

In many embodiments, face element 1022 comprises a face surface 1214 (FIG. 21) and a rear surface 1115. Meanwhile, face surface 1214 (FIG. 21) comprises a face center 1216 (FIG. 21) and a face perimeter 1217 (FIG. 21), and rear surface 1115 comprises a rear center 1118 and a rear perimeter 1119. Face surface 1214 (FIG. 21) can refer to a striking face or a striking plate of club head 1000, and can be configured to impact a ball (not shown), such as, for example, a golf ball.

Figure 21:
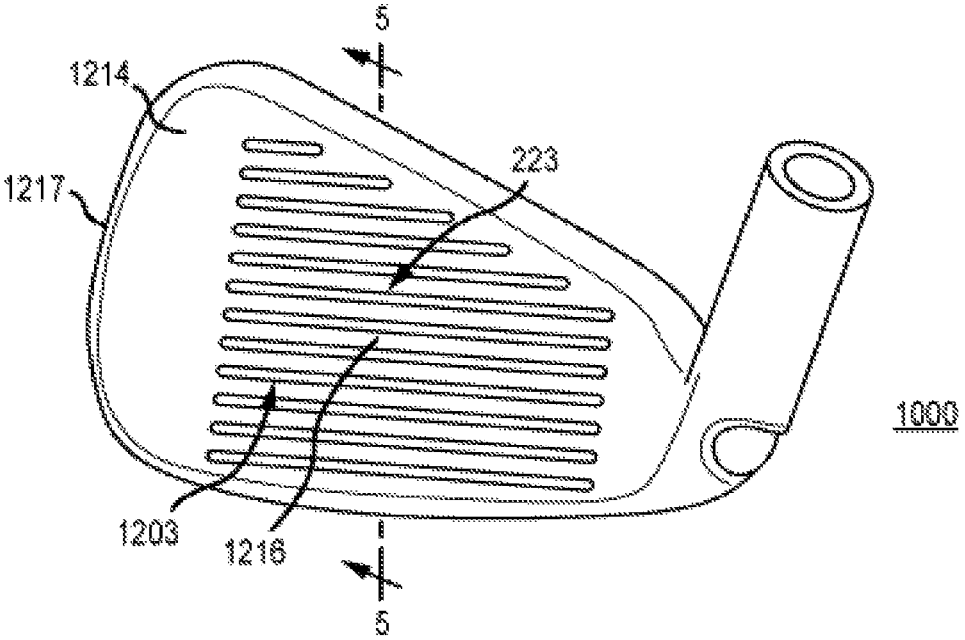
FIG. 21 is a front perspective view of the golf club head of FIG. 20.

In these or other embodiments, face surface 1214 (FIG. 21) can be located at front end 1203 (FIG. 21), and rear surface 1115 can be located at rear end 1104. Further, rear surface 1115 can be approximately opposite to face surface 1214 (FIG. 21); rear center 1118 can be approximately opposite face center 1216 (FIG. 21); and rear perimeter 1119 can be approximately opposite face perimeter 1217 (FIG. 21). Generally, in many examples, face center 1216 (FIG. 21) can refer to a geometric center of face surface 1214 (FIG. 21). Accordingly, in these or other examples, face center 1216 (FIG. 21) can refer to a location at face surface 1214 (FIG. 21) that is approximately equidistant between toe end 1014 and heel end 1016 and further that is approximately equidistant between top end or top rail 1018 and bottom end or sole 1020. In various examples, the face center can refer to the face center as defined at United States Golf Association: Procedure for Measuring the Flexibility of a Golf Clubhead, USGA-TPX 3004, Revision 1.0.0, p. 6, May 1, 2008 (retrieved May 12, 2014 from http://www.usga.org/equipment/testing/protocols/Test-Protocols-For-Equipment), which is incorporated herein by reference. Likewise, in some examples, rear center 1118 can refer to a geometric center of rear surface 1115.

Figure 20:
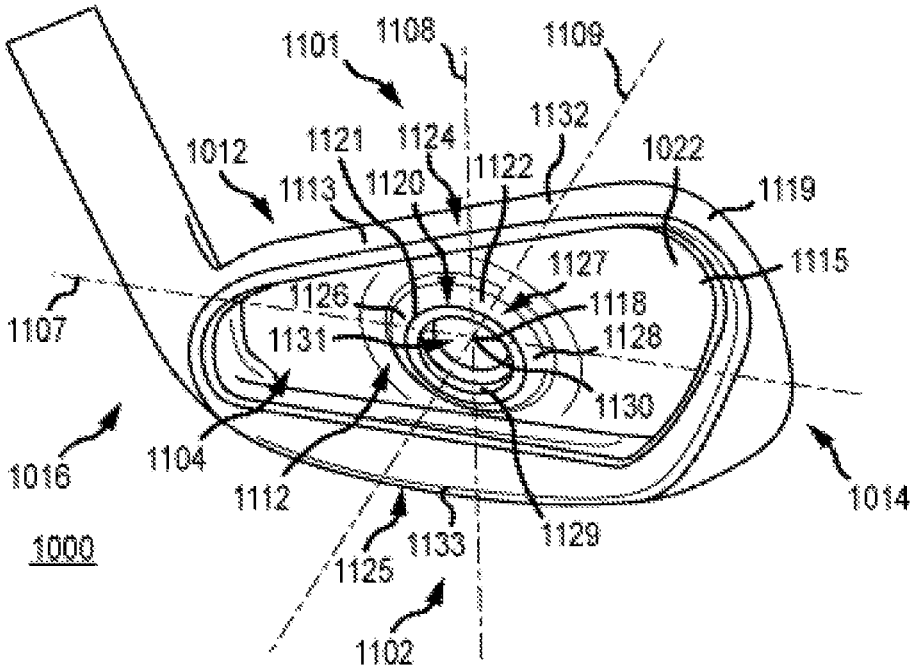
FIG. 20 is a rear perspective view of a golf club head having a reinforcement device.

By reference, x-axis 1107 and y-axis 1108 can extend approximately parallel to face surface 1214 (FIG. 20), and z-axis 1109 can extend approximately perpendicular to face surface 1214 (FIG. 20). Meanwhile, each of x-axis 1107, y-axis 1108, and z-axis 1109 can intersect rear center 1118 such that rear center 1118 comprises the origin of the Cartesian reference frame provided by x-axis 1107, y-axis 1108, and z-axis 1109.

In various embodiments, grooves 1026 (FIG. 21) can comprise one or more grooves, respectively, and can extend between toe end 1014 and heel end 1016. In these or other embodiments, grooves 1026 (FIG. 21) can be approximately parallel to x-axis 1107.

In many embodiments, reinforcement device 1112 comprises one or more reinforcement elements 1120 (e.g., reinforcement element 1121). Reinforcement device 1112 and/or reinforcement element(s) 1120 are located at rear surface 1115 and extend out from rear surface 1115 toward rear end 1024 and away from the face or front end 1022 (FIG. 20).

In many embodiments, each reinforcement element of reinforcement element(s) 1120 comprises an outer perimeter surface and a geometric center. In these or other embodiments, the geometric center(s) of one or more of reinforcement element(s) 1120 (e.g., reinforcement element 1121) can be located approximately at z-axis 1109. For example, reinforcement element 1121 can comprise outer perimeter surface 1126 and geometric center 1130. As discussed above, golf club heads 10, 100, 200, 300, 400, 500, and 700 can comprise the reinforcement device 1112 as described below.

Reinforcement device 1112 and reinforcement element(s) 1120 are configured to reinforce face element 1022 while still permitting face element 1022 to bend, such as, for example, when face surface 1214 (FIG. 21) impacts a ball (e.g., a golf ball). As a result, face element 1022 can be thinned to permit mass from face element 1022 to be redistributed to other parts of club head 1000 and to make face element 1022 more flexible without buckling and failing under the resulting bending. Advantageously, because face element 1022 can be thinner when implemented with reinforcement device 1112 and reinforcement element(s) 1120 than when implemented without reinforcement device 1112 and reinforcement element(s) 1120, the center of gravity, the moment of inertia, and the coefficient of restitution of club head 1000 can also be altered to improve the performance characteristics of club head 1000. For example, implementing reinforcement device 1112 and reinforcement element(s) 1120 can increase a flight distance of a golf ball hit with face surface 1214 (FIG. 21) by increasing a launch angle of the golf ball (e.g., by approximately 1-3 tenths of a degree), increase the ball speed of the golf ball (e.g., by approximately 0.1 miles per hour (mph) (0.161 kilometers per hour (kph) to approximately 3.0 mph (4.83 kph)), and/or decreasing a spin of the golf ball (e.g., by approximately 1-500 rotations per minute). In these examples, reinforcement device 1112 and reinforcement element(s) 1120 can have the effect of countering some of the gearing on the golf ball provided by face surface 1214 (FIG. 21).

Testing of golf clubs comprising an embodiment of golf club head 1000 was performed. Overall, when compared to an iron golf club with a standard reinforced strikeface and custom tuning port, the testing showed more forgiveness, as indicated by higher moments of inertia around the x-axis and/or the y-axis and a tighter statistical area of the impact of the golf ball on the face of the golf club head. In some testing, the moment of inertia about the x-axis increased by approximately 2%, the moment of inertia about the y-axis increased by approximately 4%, and/or the statistical area of the impact of the golf ball on the face of the golf club head was reduced by approximately 15-50 percent. Additionally, when compared to an iron golf club with a standard reinforced strikeface and custom tuning port, the testing showed increased ball speed of the golf ball, higher launch angle of the golf ball, and/or decreased spin of the golf ball were found. As an example, in testing an embodiment of golf club 1000 on a 5 iron golf club, it was found that the ball speed of the golf ball increased by approximately 1.5 mph (2.41 kph), the golf ball had an approximately 0.3 degree higher launch angle, and the spin of the golf ball decreased by approximately 250 revolutions per minute (rpm). In another example, in testing an embodiment of golf club 10 on a 7 iron golf club, it was found that the ball speed of the golf ball increased by approximately 2.0 mph (3.22 kph), the golf ball had approximately no launch angle degree change, and the spin of the golf ball decreased by approximately 450 rpm. As an additional example, in testing an embodiment of golf club 1000 on a wedge iron golf club, it was found that the ball speed of the golf ball had approximately no change in speed, the golf ball had an approximately 0.1 degree higher launch angle, and the spin of the golf ball decreased by approximately 200 rpm.

Figure 22:
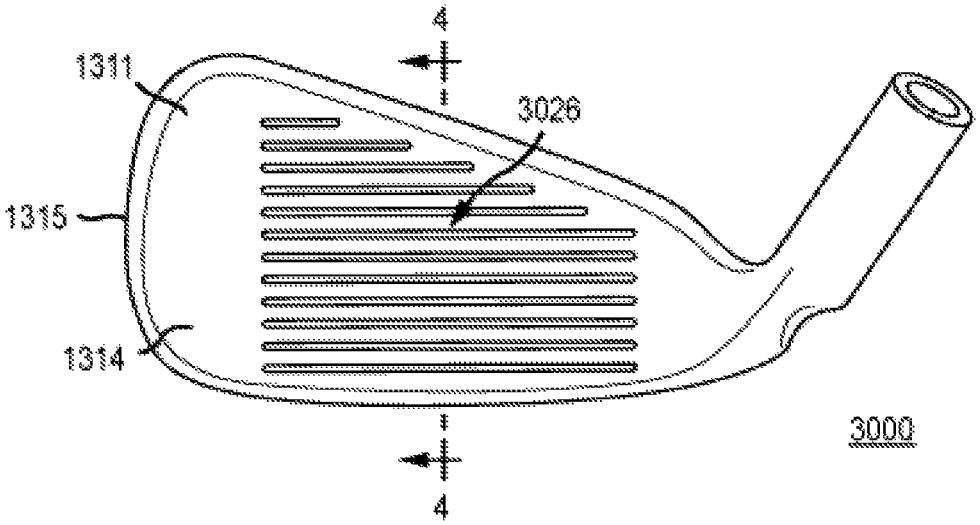
FIG. 22 is a front view of a conventional club head, according to an embodiment.
Figure 23:
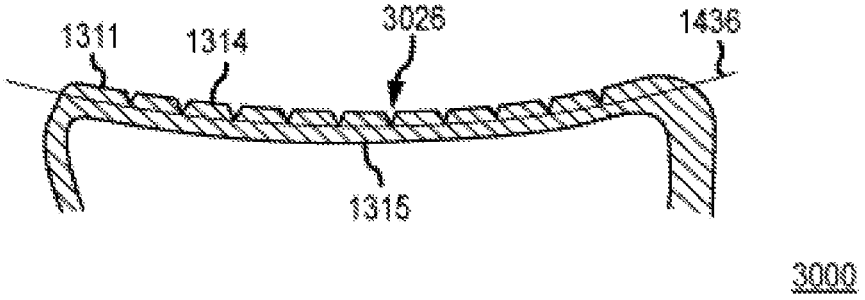
FIG. 23 is a stress-strain analysis of a partial cross-sectional view of the conventional club head taken along section line 4-4 of FIG. 22 simulating a face surface of the conventional club head impacting a golf ball (not shown), where the resulting bending is multiplied three-fold, according to the embodiment of FIG. 22.

Notably, in many examples, when face element 1022 comprises grooves 1026 (FIG. 21) and face element 1022 is thinned without implementing reinforcement device 1112 and reinforcement element(s) 1120, buckling and failure of face element 1111 can occur at the bottom of grooves 1026, particularly at grooves 1022 (FIG. 21) proximal to face center 1216 (FIG. 21), as illustrated at FIGS. 22 & 23 and described as follows with respect to FIGS. 22 & 23.

Club head 1000 having reinforcement device 1112 may also have a uniform transition thickness 1550 (FIG. 24), similar to the thin sole described above. The uniform transition thickness extends from front end 1203 to sole 1020. Uniform transition thickness 1550 absorbs stress directed to the region of club head 1000 having reinforcement device 1112 between front end 1203 and sole 1020. Uniform transition thickness 1550 may range from approximately 0.20-0.80 inches. For example, uniform transition thickness 1550 may be approximately 0.20, 0.25, 0.30, 0.35 0.40, 0.45, 0.50, 0.55, 0.60, 0.65, 0.70, 0.75, or 0.80 inches.

Specifically, turning ahead in the drawings, FIG. 22 illustrates conventional club head 3000, according to an embodiment. Club head 3000 can be similar to club head 1000 (FIGS. 20 & 21), but unlike club head 1000, is devoid of a reinforcement device and reinforcement elements at rear surface 1315 of face element 1022 of club head 3000. Club head 3000 comprises one or more grooves 3026 at face surface 1314 of club head 3000. Rear surface 1315 can be similar to rear surface 1115 (FIG. 21); face element of club head 3000 can be similar or identical to face element 1022 (FIG. 21); face surface 1314 can be similar or identical to face surface 1214 (FIG. 21); and/or grooves 3026 of club head 3000 can be similar or identical to grooves 1026 of club head 1000 (FIG. 21). Meanwhile, FIG. 23 illustrates a stress-strain analysis of a partial cross-sectional view of club head 3000 taken along section line 4-4 of FIG. 22 simulating face surface 1314 of club head 3000 impacting a golf ball (not shown) where the resulting bending is multiplied threefold, according to the embodiment of FIG. 22.

As demonstrated at FIG. 23, face element 1022 behaves similarly to a simply supported beam and thus comprises neutral axis 1436. The portion of face element 1022 between face surface 1314 and neutral axis 1436 is in compression, and the portion of face element 1022 between neutral axis 1436 and rear surface 1315 is in tension. Stress builds first at face surface 1314 and rear surface 1315 and moves inward toward neutral axis 1436. However, unlike a simply supported beam, face element 1311 also comprises grooves 1026 at the portion of face element 1022 that is in compression. When face element 1022 bends too much, the mechanical yield of face element 1022 in the bottom of grooves 1026 can be reached. If not for grooves 1026, face element 1022 would ordinarily be expected to fail first in the portion of face element 1022 that is under tension, but grooves 1026 cause failure to occur first at the portion of face element 1022 that is in compression. Namely, face element 1022 fails at grooves 1026 before the remainder of face element 1022 has a chance to reach high enough stress levels to result in failure. Iron-type club heads can be more susceptible to failure at grooves because iron-type club heads tend to be flat at face surface 1314, unlike wood-type golf club head which tend to be convex at face surface 1314. As a result, when wood-type golf club heads bend at face surface 1314, face surface 1314 can still be bowed somewhat outward. On the other hand, when iron-type golf club heads bend at face surface 1314, face surface 1314 can bend to a concave shape that increases the extent of the compression at the portion of face element 22 that is under compression.

Turning now back to FIGS. 20 and 21, implementing reinforcement device 1112 and reinforcement element(s) 1120 can reinforce a localized bending in grooves 1026 (FIG. 21), particularly in those grooves 1026 that are proximal to face center 1216 (FIG. 21), while permitting increased overall bending in face element 1111. Reinforcement device 1112 and reinforcement element(s) 1120 are able to provide these benefits by increasing the localized thickness of face element 1022, making face element 1022 stiffer and harder in those locations. In effect, reinforcement device 1112 and reinforcement element(s) 1120 are operable to pull a neutral axis of face element 1022 away from face surface 1214 (FIG. 21) and closer to rear surface 1115.

Meanwhile, reinforcement device 1112 and reinforcement element(s) 1120 are further able to provide these benefits when implemented as a closed structure (e.g., one or more looped ribs) because such closed structures are able to resist deformation as a result of circumferential (i.e., hoop) stresses acting on reinforcement device 1112 and reinforcement element(s) 1120. For example, circumferential (i.e., hoop) stresses acting on reinforcement device 1112 and reinforcement element(s) 1120 can prevent opposing sides of reinforcement device 1112 and reinforcement element(s) 1120 from rotating away from each other, thereby reducing bending.

In implementation, reinforcement element(s) 1120 (e.g., reinforcement element 1121) can be implemented in any suitable shape(s) (e.g., polygonal, elliptical, circular, etc.) and/or in any suitable arrangement(s) configured to perform the intended functionality of reinforcement device 1112 and/or reinforcement element(s) 1120 as described above. Further, when reinforcement element(s) 1120 comprise multiple reinforcement elements, two or more reinforcement elements of reinforcement element(s) 1120 can be similar to another, and/or two or more reinforcement elements of reinforcement element(s) 1120 can be different from another.

In some embodiments, reinforcement element(s) 1120 (e.g., reinforcement element 1121) can be symmetric about x-axis 1107 and/or y-axis 1108. When reinforcement element(s) 1120 (e.g., reinforcement element 1121) are implemented with an oblong shape, in many embodiments, a largest dimension (e.g., major axis) of the reinforcement element(s) can be parallel and/or co-linear with one of x-axis 1107 or y-axis 1108. However, in other embodiments, the largest dimension (e.g., major axis) can be angled with respect to x-axis 1107 and/or y-axis 1108, as desired. Further, in many embodiments, reinforcement element(s) 1120 (e.g., reinforcement element 1121) can be centered at z-axis 1109, but in some embodiments, one or more of reinforcement element(s) 1120 (e.g., reinforcement element 1121) can be biased off-center of z-axis 1109, such as, for example, biased toward one or two of top end 1018, bottom end 1020, toe end 1014, and heel end 1016.

In many embodiments, each reinforcement element of reinforcement element(s) 1120 (e.g., reinforcement element 1121) can comprise one or more looped ribs 1127 (e.g., looped rib 1122). Specifically, reinforcement element 1121 can comprise looped rib 1122. In these or other embodiments, when looped rib(s) 1127 comprise multiple looped ribs, looped rib(s) 1127 can be concentric with each other about a point and/or axis (e.g., z-axis 1109). In other embodiments, when looped rib(s) 1127 comprise multiple looped ribs, looped rib(s) 1127 can be concentric with each other about a point and/or axis. In other embodiments, when looped rib(s) 1127 comprise multiple looped ribs, two or more of looped rib(s) 1127 can be nonconcentric. Further, in these or other embodiments, two or more of looped rib(s) 1127 can overlap. Meanwhile, in these embodiments, looped rib 1122 can comprise an elliptical looped rib, and in some of these embodiments, looped rib 1122 can comprise a circular looped rib. As noted above, implementing reinforcement element(s) 120 as looped rib(s) 1127 can be advantageous because of the circumferential (e.g., hoop) stress provided by the closed structure of looped rib(s) 1127. In many embodiments, one or more of (or each of) looped rib(s) 1127 is a continuous closed loop.

In these or other embodiments, each looped rib of looped rib(s) 1127 comprises an outer perimeter surface and an inner perimeter surface. Meanwhile, in these embodiments, the outer perimeter surface of each reinforcement element (e.g., reinforcement element 121) comprises the outer perimeter surface of the looped rib corresponding to that reinforcement element (e.g., looped rib 1122). For example, looped rib 1122 can comprise outer perimeter surface 1128 and inner perimeter surface 1129. Further, inner perimeter surface 1129 can be steep and substantially orthogonal at rib height 1540 (FIG. 28) relative to the rear surface.

In some embodiments, one or more outer perimeter surface(s) of reinforcement element(s) 1120 (e.g., outer perimeter surface 1126 of reinforcement element 1121) can be filleted with rear surface 1115. In these or other embodiments, one or more inner perimeter surface(s) of looped rib(s) 1127 (e.g., inner perimeter surface 1129 of looped rib 1122) can be filleted with rear surface 1115. Filleting the outer perimeter surface(s) of reinforcement element(s) 1120 (e.g., outer perimeter surface 1126 of reinforcement element 1121) with rear surface 1115 can permit a smooth transition of reinforcement element(s) 1120 (e.g., outer perimeter surface 1126 of reinforcement element 1121) into rear surface 1115. Meanwhile, inner perimeter surface(s) of looped rib(s) 1127 (e.g., inner perimeter surface 1129 of looped rib 1122) can be filleted with rear surface 1115 with a fillet having a radius of greater than or equal to approximately 0.012 centimeters.

The reinforcement element on the rear surface of the face element comprising a fillet between the outer perimeter of the reinforcement element and the rear surface of the face element, beneficially allows impact stresses to be transferred from the face element into the reinforcement element.

The transfer of impact stress away from the face element and into the reinforcement element allows the center of the face element to be thinned to increase face deflection and ball speed on impact with a golf ball. Accordingly, the face element can be thinner within the inner perimeter surface than without or outside the outer perimeter surface of the reinforcement element.

Figure 26:
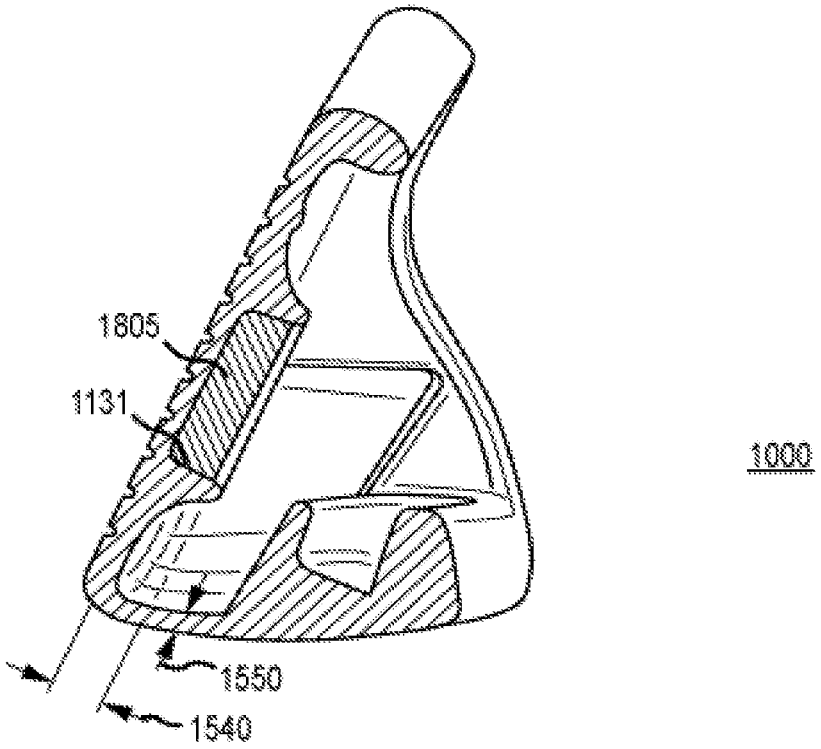
FIG. 26 is a side cross-sectional view of the club head taken along section line 5-5 of FIG. 21, according to a different embodiment of FIG. 20.
Figure 27:
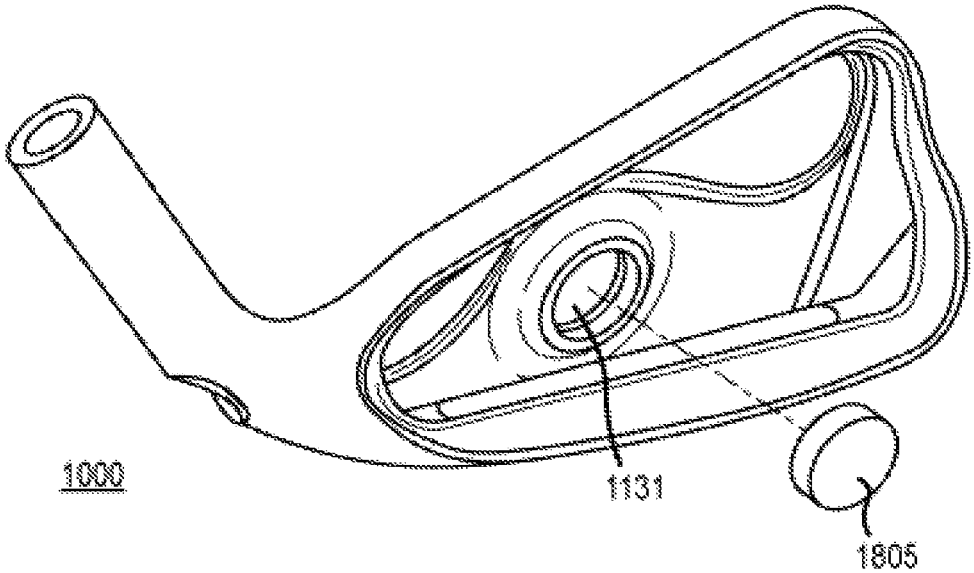
FIG. 27 is a top, rear, heel side view of a club head, according to the embodiment of FIG. 26.

In some embodiments, when reinforcement element 1121 comprises looped rib 1122, looped rib 1122 can comprise cavity 1131. In other embodiments, when reinforcement element 1121 comprises looped rib 1122, looped rib 1122 does not comprise cavity 1131. In embodiments without cavity 1131, the center thickness 1537 (FIGS. 24 and 13) can be greater than in embodiments with cavity 1131 and can be less than or equal to the face thickness at rib height 1542 (FIGS. 24 and 28), which can be measured from face surface 1214 (FIG. 21) to the distal end of looped rib 1122 (e.g., the combined distance of center thickness 1537 (FIG. 24) and rib height 1542 (FIG. 24)). Cavity 1131 is defined by inner perimeter surface 1129 and rear surface 1115. In some embodiments, cavity 1131 can be a central cavity. In many embodiments, cavity 1131 can be devoid of any contents, such as, for example, a weighted insert. In other embodiments, cavity 1131 can contain an insert 1805 as shown in FIGS. 26 and 27. These inserts can be similar to insert 50, 150, 250, 350, and 450.

As discussed in some detail above, by implementing reinforcement device 1112 and reinforcement element(s) 1120, face surface 1214 (FIG. 21) can be nearer to rear surface 1115 (i.e., thinner) proximal to (e.g., at) face center 1216 (FIG. 21) than proximal to (e.g., at) face perimeter 1217 (FIG. 21). In some embodiments, a portion of face surface 1214 (FIG. 21) that is proximal to face center 1216 (FIG. 21) can refer to a portion of the surface area of face surface 1214 bounding face center 1216 (FIG. 21) and representing approximately one percent, two percent, three percent, five percent, ten percent, or twenty percent of a total surface area of face surface 1214. In these or other embodiments, the portion of the surface area of face surface 1214 (FIG. 21) can correspond to a portion of the surface area of rear face 1115 covered by reinforcement element 1121. Meanwhile, in some embodiments, a portion of face surface 1214 (FIG. 21) that is proximal to face perimeter 1217 (FIG. 21) can refer to a region of face surface 1214 bounded by face perimeter 1217 and an inset boundary located approximately 0.10 centimeters, 0.20 centimeters, 0.25 centimeters, 0.50 centimeters, 1.00 centimeters, or 2.00 centimeters from face perimeter 1217 (FIG. 21).

Figure 24:
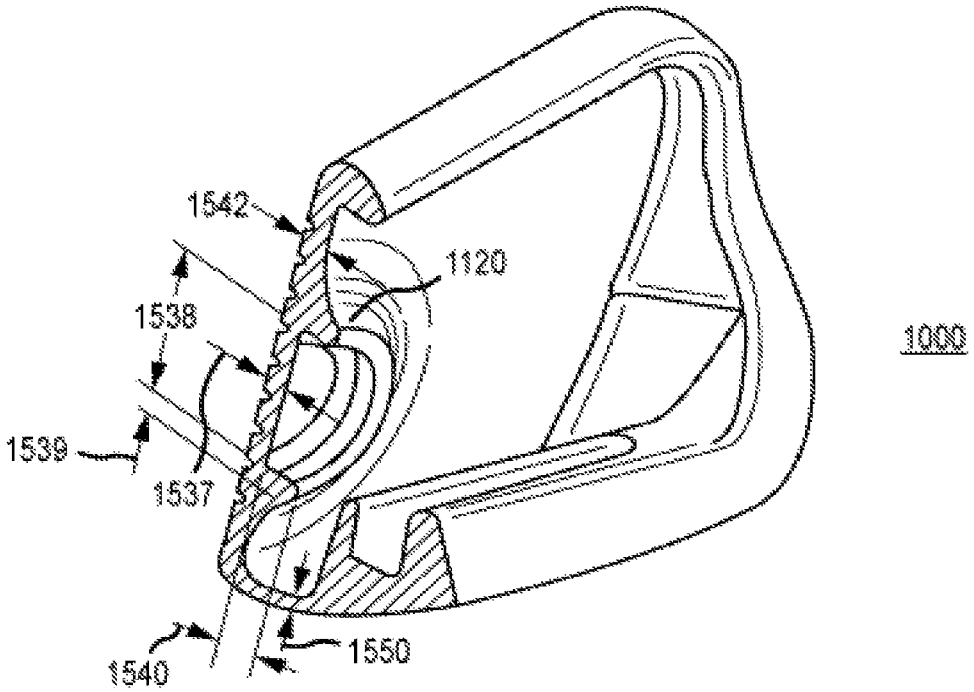
FIG. 24 is a cross-sectional view of the club head taken along section line 5-5 of FIG. 21, according to the embodiment of FIG. 20.
Figure 28:
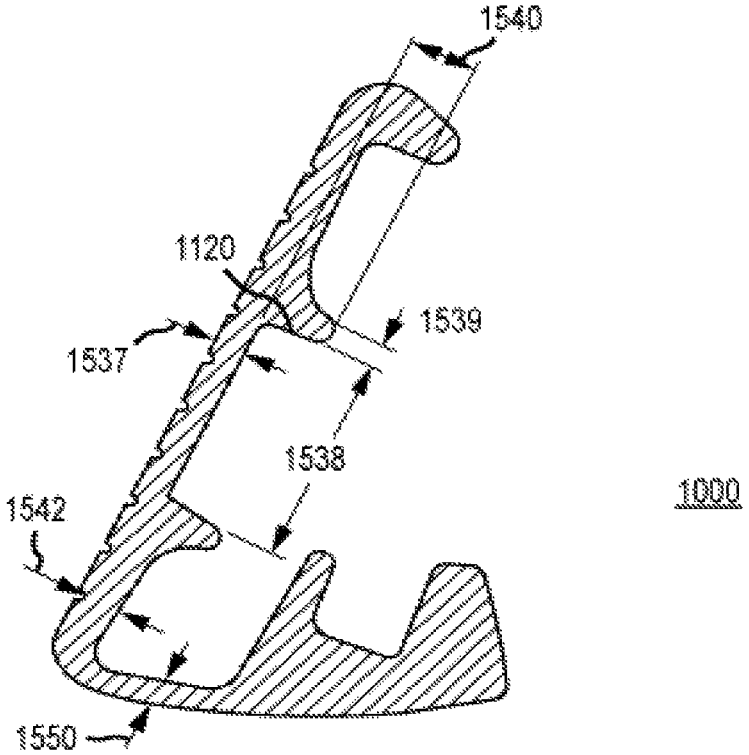
FIG. 28 is a side view of the club head taken along section line 5-5 of FIG. 21, according to the embodiment of FIG. 20.

Turning ahead briefly in the drawings, FIGS. 24 and 28 illustrate a cross-sectional view of club head 1000 taken along section line 5-5 of FIG. 21, according to the embodiment of FIG. 20. Club head 1000 can comprise center thickness 1537. Center face thickness 1537 can refer to a distance from face center 1216 (FIG. 21) to rear center 1118 (FIG. 20). In many embodiments, center thickness 1537 can be approximately 0.150 cm to approximately 0.300 cm. In some embodiments, center thickness 1537 can be less than 0.300 cm, less than 0.255 cm, less than 0.250 cm, less than 0.205 cm, less than 0.200 cm, or less than 0.155 cm. In some embodiments, the center of reinforcement element 1120 can be at least partially filled in. For example, the center of reinforcement element 1120 can be filled in with a damping material or a vibration attenuating feature (e.g., insert 1805 (FIG. 27)) or other material. In many embodiments, center thickness 1537 can be thinner than a face thickness at rib height 1540. In other embodiments, center thickness 1537 can be approximately equal to the face thickness at rib height 1540. The face thickness at rib height 1540 can be rib height 1540 added to center thickness 1537. In many embodiments, face thickness 1542 outside of reinforcement element 1120 can be thicker than center thickness 1537, but thinner than the face thickness at rib height 1540. In other embodiments, face thickness 1542 can be the same as center thickness 1537. In many embodiments, a center thickness from the face center 1216 to the rear center 1118 is less than or equal to approximately 0.203 centimeters.

In some embodiments, a width of the rib can change throughout looped rib 1122 (FIG. 20), In some embodiments, looped rib 1122 (FIG. 20) and/or inner perimeter surface 1129 (FIG. 20) can comprise largest rib span 1538. Largest rib span 1538 can refer to the largest distance from one side of inner perimeter surface 1129 (FIG. 20) across to an opposing side of inner perimeter surface 1129 (FIG. 20) measured parallel to rear surface 1115 (FIG. 20). Accordingly, when looped rib 1122 (FIG. 20) comprises an elliptical looped rib, largest rib span 1538 can refer to a major axis of inner perimeter surface 1129 (FIG. 20). Further, when looped rib 1122 (FIG. 20) comprises a circular looped rib, largest rib span 1538 can refer to a diameter of inner perimeter surface 1129 (FIG. 20). Notably, in many embodiments, largest rib span 1538 can be measured at a midpoint of inner perimeter surface 1129 (FIG. 20).

In some embodiments, largest rib span 1538 can be approximately 0.609 cm to approximately 1.88 cm. In some embodiments, largest rib span 1538 can be approximately 1.0 cm. In some embodiments, when largest span 1538 is too large (e.g., greater than approximately 1.88 centimeters), looped rib 1122 (FIG. 20) can be insufficient to reinforce grooves 1028 (FIG. 21) nearest to face center 1216 (FIG. 21). Meanwhile, in these or other embodiments, when largest span 1538 is too small (e.g., less than approximately 0.609 centimeters), looped rib 1122 can be insufficient to reinforce grooves 1028 (FIG. 21) nearest to face perimeter 1217 (FIG. 21). Generally, these upper and lower limits on largest rib span 1538 can be a function of a size of face element 1111 (FIG. 20).

The rib span plays an important role in the amount of stress that is transferred from the face element into the end portion or rear end of the reinforcement device due to the fillet. Specifically, the rib span transfers the stress of impact generated at the face into a hoop stress within the reinforcement device. A rib span smaller than the described rib span can result in a large portion of the impact stress concentrating on the front and rear of the face element around the perimeter of the reinforcement element, creating a stress rise on the face element. A rib span larger than the described rib span can result in a large portion of the impact stress concentrating centrally on the front and rear of the face element, creating a stress riser on the face element. The described rib span corresponding to the impact area of a golf ball, in combination with the fillet, results in the significant stresses being transferred away from the face element and into the reinforcement device, thereby reducing the stress on the face element.

Figure 25:
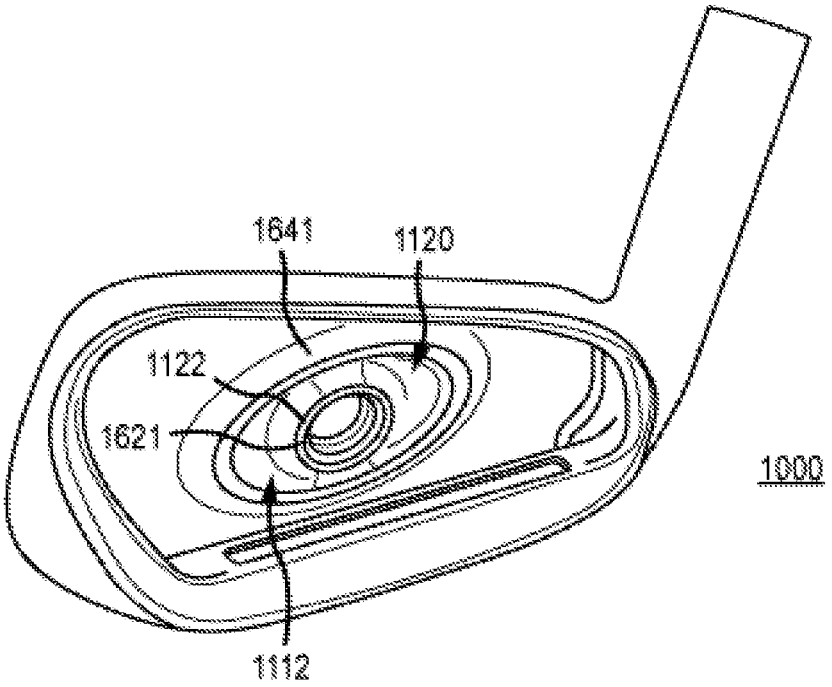
FIG. 25 is a rear perspective view of a golf club head having a reinforcement device according to a different embodiment.

In some embodiments, two or more ribs 1621 and 1641 can be present, for example as shown in FIG. 25. In this case, the larger rib span or inner or outer diameter of rib 1641 (FIG. 25) can be greater than 1.88 centimeters, and the smaller rib span or inner or outer diameter of rib 1621 (FIG. 25) can be less than 0.609 centimeters.

Further, looped rib 1122 (FIG. 20) can comprise a rib thickness 1539. Rib thickness 1539 can refer to a distance between inner perimeter surface 1129 (FIG. 20) of looped rib 1122 (FIG. 20) and outer perimeter surface 1128 (FIG. 20) of looped rib 1122 (FIG. 20) measured parallel to rear surface 1115 (FIG. 20). In some embodiments, the thickness of looped rib 1122 (FIG. 20) can vary throughout looped rib 1122 (FIG. 20), and rib thickness 1539 can be a maximum rib thickness of looped rib 1122 (FIG. 20). In many embodiments, rib thickness 1539 can be approximately 0.050 cm to approximately 1.50 cm. In some embodiments, rib thickness 1539 can be approximately 0.05 cm. In some embodiments, rib thickness 1539 can be greater than or equal to approximately 0.25 centimeters. In some embodiments, rib thickness 539 can be approximately 0.50 centimeters. In some embodiments, rib thickness 539 can be approximately 0.75 centimeters. In some embodiments, rib thickness 539 can be approximately 1.00 centimeters. In some embodiments, rib thickness 539 can be approximately 1.25 centimeters. In some embodiments, rib thickness 539 can be approximately 1.50 centimeters. In various embodiments, when looped rib(s) 1127 (FIG. 20) comprises multiple looped ribs, two or more looped ribs of looped rib(s) 1127 (FIG. 20) can comprise the same rib thicknesses, and/or two or more looped ribs of looped rib(s) 1127 (FIG. 20) can comprise different rib thicknesses. Notably, in many embodiments, rib span 1539 can be measured at a midpoint of inner perimeter surface 1129 (FIG. 20) and/or outer perimeter surface 1128 (FIG. 20).

Further still, looped rib 1122 (FIG. 20) can comprise rib height 1540. Rib height 1540 can refer to a distance perpendicular from rear surface 1115 (FIG. 20) to a center location of looped rib 1122 (FIG. 20) farthest from rear surface 1115 (i.e., where outer perimeter surface 1128 (FIG. 20) interfaces with inner perimeter surface 1129 (FIG. 20). In these or other embodiments, rib height 1540 can be greater than or equal to approximately 0.3048 centimeters. In some embodiments, rib height 1540 can be approximately 0.1778 cm to approximately 0.3048 cm. In some embodiments, rib height 1540 can be approximately 0.17 cm, 0.20 cm, 0.23 cm, 0.26 cm, 0.29 cm, or 0.30 cm. In many embodiments, rib height 1540 can be less than or equal to approximately 0.512 cm. In some embodiments, the height of looped rib 1122 (FIG. 20) can vary throughout looped rib 1122, and rib height 1540 can be a maximum rib height of looped rib 1122 (FIG. 20). In various embodiments, when looped rib(s) 1127 (FIG. 20) comprises multiple looped ribs, two or more looped ribs of looped rib(s) 1127 (FIG. 20) can comprise the same rib heights, and/or two or more looped ribs of looped rib(s) 1127 (FIG. 20) can comprise different rib heights.

In many embodiments, center thickness 1537, largest rib span 1538, rib thickness 1539, and/or rib height 1540 can depend on one or more of each other. For example, center thickness 1537 can be a function of rib thickness 1539 and rib height 1540. That is, for an increase in rib thickness 1539 and/or rib height 1540, center thickness 1537 can be decreased, and vice versa. Meanwhile, rib thickness 1539 and rib height 1540 can be dependent on each other. For example, increasing rib thickness 1539 can permit rib height 1540 to be decreased, and vice versa.

Returning now to FIGS. 20 & 21, in many embodiments, perimeter wall element 1113 can comprise a first perimeter wall portion 1124 and a second perimeter wall portion 1125. Perimeter wall element 1113 extends (i) at least partially (e.g., entirely) around rear perimeter 1119 of rear surface 1115, (ii) out from rear surface 1115 toward rear end 1104 and (iii) away from front end 1203 (FIG. 21). Meanwhile, first perimeter wall portion 1124 can extend along rear perimeter 1119 of rear surface 1115 at top end 1101, and second perimeter wall portion 1125 can extend along rear perimeter 1119 of rear surface 1115 at bottom end 1102. In many embodiments, reinforcement device 1112 and reinforcement element(s) 1120 are separate and/or located away from perimeter wall element 1113 at rear surface 1115 so that reinforcement device 1112 and reinforcement element(s) 1120 float at rear surface 1115. By floating reinforcement device 1112 and reinforcement element(s) 1120, face element 1111 can be permitted to bend approximately symmetrically about face center 1216 (FIG. 21).

In many embodiments, club head body 1012 can comprise (i) a top surface 1132 at least partially at first perimeter wall portion 1124 and/or top end 1101, and/or (ii) a sole surface 1133 at least partially at second perimeter wall portion 1125 and/or bottom end 1102. Accordingly, in some embodiments, first perimeter wall portion 1124 can comprise at least part of top surface 1132; and/or second perimeter wall portion 1125 can comprise at least part of sole surface 1133. Further, top surface 1132 can interface with face surface 1214 (FIG. 21) at top end 1101; and/or sole surface 1133 can interface with face surface 1214 (FIG. 21) at bottom end 1102.

In some embodiments, at least part of second perimeter wall portion 1125 can be approximately equal thickness with or thinner than face element 1111 at face perimeter 1217 (FIG. 21) and/or proximal to face perimeter 1217. For example, second perimeter wall portion 1125 can be equal thickness with or thinner than face element 1111 at face perimeter 1217 (FIG. 21) and/or proximal to face perimeter 1217 at a portion of second perimeter wall portion 1125 that is proximal to face perimeter 1217 (i.e., where second perimeter wall portion 1125 interfaces with face element 1111). Implementing this portion of second perimeter wall portion 1125 to be equal thickness with or thinner than face element 1111 at face perimeter 1217 (FIG. 21) and/or proximal to face perimeter 1217 can prevent stress risers from forming at second perimeter wall portion 1125 when face surface 1214 (FIG. 21) impacts a golf ball.

Rear surface 1115 comprises a first rear surface portion and a second rear surface portion. The first rear surface portion can refer to the part of rear surface 1115 covered by perimeter wall element 1113, and the second rear surface portion can refer to the remaining part of rear surface 1115. In many embodiments, reinforcement element 1121 (e.g., looped rib 1122) can cover greater than or equal to approximately 25 percent of a surface area of the second rear surface portion of rear surface 1115 and/or less than or equal to approximately 40 percent of a surface area of the second rear surface portion of rear surface 1115. In other embodiments, reinforcement element 1121 (e.g., looped rib 1122) can cover greater than or equal to approximately 30 percent of a surface area of the second rear surface portion of rear surface 1115. In some embodiments, reinforcement element 1121 (e.g., looped rib 1122) can cover approximately 25 percent, 28 percent, 31 percent, 34 percent, 37 percent or 40 percent of a surface area of the second rear surface portion of rear surface 1115.

Referring to FIGS. 26 and 27, in some embodiments, insert 1805 can be a vibration attenuating feature. Insert 1805 can be a non-metallic material, an elastomeric material such as polyurethane, or another material such as foam. Insert 1805 can be used to adjust the sound and feel of club head 1000. By absorbing or damping vibration, insert 1805 improves the feel of club head 1000. In addition, insert 1805 absorbs the sound of a golf ball striking the face, making golf club 1000 head feel less hollow and more solid. In further embodiments, a badge (not shown) can at least partially cover cavity 1131. The badge can be separate from insert 1805 or can be integral with insert 1805. In other embodiments, the badge can be integral with the reinforcement element, such as reinforcement element 1120 (FIG. 20).

In some cases, the weight of insert 1805 can be less than about 3 g so as to not significantly affect the swing weight or the center of gravity of club head 1000. In other embodiments, insert 1805 weight can be more than about 3 g, such as about 5 g to about 10 g, and can contribute substantially to the swing weight and/or the center of gravity of club head 800. In some embodiments, insert 1805 can be adhered to cavity 1131 using an epoxy adhesive, a viscoelastic foam tape, the vibration attenuating feature, or a high strength tape such as 3M™ VHB™ tape. In other embodiments, insert 1805 can be poured and bonded directly into cavity 1131. The badge can be bonded with similar adhesives. In some embodiments, insert 1805 or the badge can be flush with looped rib 1122 (FIG. 1) at the top of rib height 1540, or they can be below rib height 1540 when fully assembled.

In some embodiments, at least one vibration attenuating feature (e.g., insert 1805 (FIG. 28) can be disposed on rear surface 1115 (FIG. 20) of the golf club head, such as golf club head 1000. The vibration attenuating feature can produce a more desirable sound from the golf club head 1000 upon impact. The thin face element 1111 (FIG. 20) of golf club head 1000 can cause undesirable sounds when striking a golf ball. The vibration attenuating feature can reduce the vibrations leading to a more desirable sound on impact by thin face element 1111 (FIG. 20). By providing a more desirable noise, the vibration attenuating component can increase a user's confidence during use. The vibration attenuating feature can also reduce the vibrational shock felt by the user of the golf club upon striking the golf ball. Furthermore, the vibration attenuating feature may reduce vibrational fatigue to decrease wear on golf club 1000 and various features such as, but not limited to, cavity 1131 or weight cavity 1135 (FIG. 20). The reduced vibrational fatigue can further lower the risk of loosening or displacement of parts such as, but not limited to, insert 1805 of cavity 1131 or an insert in weight cavity 1135 (FIG. 20). The reduced vibrational fatigue may extend the performance life of golf club head 1000.

In further embodiments, the vibration attenuating feature may comprise at least one layer of a viscoelastic damping material. The damping material may comprise a pressure sensitive viscoelastic acrylic polymer and aluminum foil forming a damping foil such as 3M™ Damping Foil Tape. The damping foil may comprise an adhesive layer. In one embodiment the vibration attenuating feature may comprise at least one viscoelastic adhesive layer which may comprise a composition of varying layers of at least one layer of epoxy adhesive, a viscoelastic foam tape, and/or a high strength tape such as 3M™ VHB™ tape. In some embodiments, the vibration attenuating feature may comprise various layer combinations of at least one of viscoelastic adhesive, damping foil, and/or a badge.

Returning to FIG. 26, in some embodiments, the vibration attenuating feature can be disposed on the rear surface 1115 (FIG. 20) of the golf club head, such as golf club head 1000, which comprises a rear surface material such as iron steel. In another embodiment, the vibration attenuating feature can be disposed in cavity 1131, or on or under insert 1805 of the golf club head 1000. The vibration attenuating feature can be located in various locations of the rear surface 1115 (FIG. 20) of the golf club head 1000. Generally, the vibration attenuating feature is at least partially located under the profile of the badge on the rear surface 1115 (FIG. 20). In some embodiments, the vibration attenuating feature is disposed under the entirety of the badge profile. In other embodiments, the vibration attenuating feature is at least partially disposed under only particular regions of the badge profile such as the aluminum or elastomer regions. The vibration attenuating feature can be disposed under only at least part of the perimeter region of the badge profile. In some embodiments the vibration attenuating feature can be disposed at least partially in cavity 1131 of the golf club head 1000. The vibration attenuating feature may be disposed at least partially on or under insert 1805 within cavity 1131. In many embodiments the disposition of the vibration attenuating feature on golf club head 1000 will comprise varying combinations the foil being disposed at least partially under the badge, at least partially over insert 1805, at least partially in weight cavity 1135 (FIG. 1), and/or at least partially in cavity 1131. In some embodiments, the vibration attenuating feature will be disposed such that it covers at least 10 percent of the surface area of rear surface 1115 (FIG. 20). In other embodiments, the vibration attenuating feature may cover at least 15, 20, 25, 30, 35, 40, 45, 50, 55, 60, 65, 70, 75, 80, 85, 90, 95, or 100 percent of the surface area of rear surface 1115.

VI) Golf Club Head Comprising a Dual Density Weight

Figure 18:
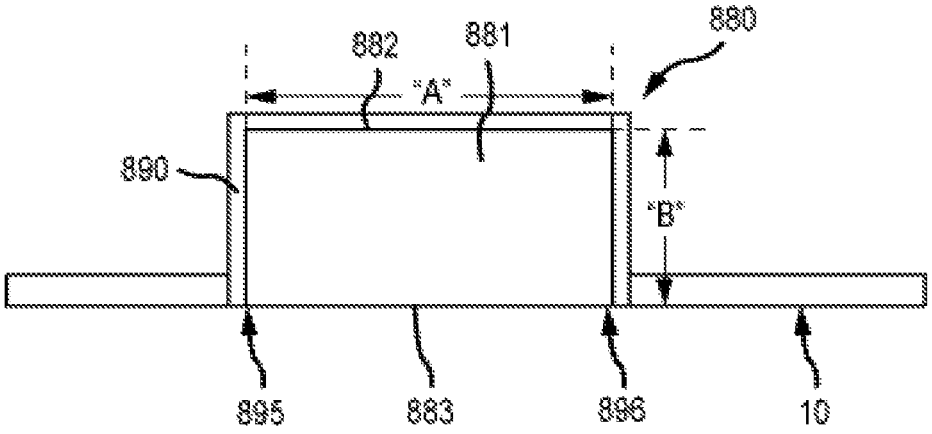
FIG. 18 is a front view of a multi-material weight.
Figure 19:
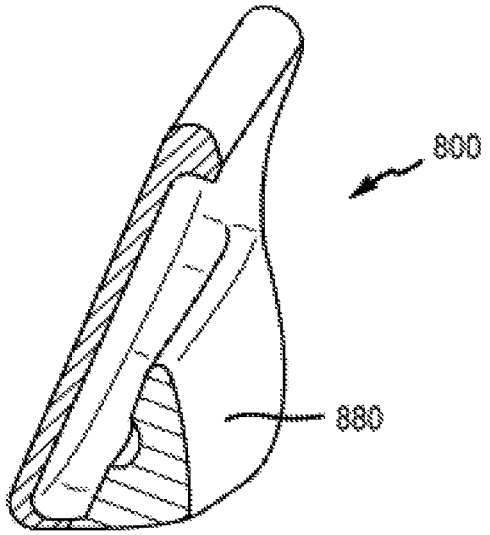
FIG. 19 is a cross-sectional view of a golf club head comprising the multi-material weight of FIG. 18.

Instead of, or in addition to each of the aforementioned deflection features, the golf club head 10 can comprise a dual density weight. FIG. 18 illustrates the golf club head 800 comprising a dual density weight 880 positioned in the rear end 824 of the golf club head 800. The golf club head 800 is similar to golf club heads 10, 100, 200, 300, 400, 500, and 700, except golf club head 800 comprises a dual density weight 880. In some embodiments, the golf club head 800 can further include one or more deflection feature of the golf club head 10, 100, 200, 300, 400, 500, 700, and 1000 discussed above, including an insert, a thin uniform sole, or an optimized material, a reinforcement device, and/or thin face.

For exemplary purposes only, the dual density weight 880 can be located toward the heel end, toward the toe end, toward the top rail, toward the sole, toward the rear end, near the center of the club head, or any combination of the described locations. For example, the dual density weight 880 can be located toward the toe end and sole end, toward the heel end and sole end, toward the rear end and toe end sole, toward the top rail and heel end, toward the top rail and toe end, toward the sole near the center of the club head, or toward the top rail near the center of the club head. Further, the dual density weight 880 can be located on club head 10, 100, 200, 300, 400, 500, 700, and 1000.

Referring to FIG. 18, an embodiment of the dual density weight 880 welded to the golf club head 800 is displayed. The dual density weight 880 can include a base portion 881 and a shell portion 890. The base portion 880 comprises a first surface 882 exposed to the exterior of the club head 800 and a second surface 882 opposite the first surface 881. The shell portion 890 surrounds the exterior portion of the base portion 881, such that the only portion of the dual density weight 880 in contact with the golf club head 800 is the shell portion 890. In other words, the shell portion 890 spaces the base portion 881 from the golf club head 800. In many embodiments, the shell portion 890 surrounds all surfaces of the base portion 881 except for the first surface 882. In some embodiments, the shell portion 890 can surround the entire base portion 881 including the first side 882. In other embodiments, the shell portion 890 can surround any portion of the base portion 881, such that it creates a space between the base portion 881 and the golf club head 800.

With continued reference to FIG. 18, the dual density weight 880 is welded to the golf club head 800 along the perimeter of the of the shell portion 890. In the illustrated embodiment, the first surface 882 of the dual density weight 880 is flush with the exterior surface of the golf club head 800 when welded. In other embodiments, the dual density weight 800 may have an offset distance extending either outward or inward from the exterior surface of the golf club head 800. The first surface 882 can comprise a curved or oblong first surface 882 to generally match the contour of the golf club head 800. The first surface 882 can also comprise a flat first surface 882 extending between the weld points 895 and 896.

In the illustrated embodiment, the base portion 881 comprises approximately 90% of the dual density weight 880 total volume, while the shell portion comprises approximately 10% of the dual density weight 880 total volume. In other embodiments, the base portion 881 can comprise approximately 40%, 50%, 60%, 70%, 80%, 90%, or 95% of the dual density weights total volume. In the illustrated embodiment, the dual density weight 880 includes a rectangular cross-section. In other embodiments, the dual density weight 880 can include any cross-sectional shape, such as circular, triangular, polygonal or any other suitable shape. The dual density weight 880 can have a thickness "A" measured between the first weld spot 141 and the second weld spot 896. In some constructions, the thickness "A" can be between 0.1 and 1.5 inches. In other embodiments, the thickness "A" can be between 0.1-0.4, 0.3-0.7, 0.6-1.0, 0.9-1.3, or 1.2-1.5 inches. For example, in some constructions, the thickness "A" can be 0.1 inch, 0.15 inch, 0.20 inch, 0.25 inch, 0.3 inch, 0.35 inch, 0.4 inch, 0.45 inch, 0.5 inch, 0.55 inch, 0.6 inch, 0.65 inch. 0.7 inch, 0.75 inch, 0.8 inch, 0.85 inch, 0.9 inch, 0.95 inch, 1.0 inch, 1.05 inch, 1.1 inch, 1.15 inch, 1.2 inch, 1.25 inch, 1.3 inch, 1.35 inch, 1.4 inch, 1.45 inch, or 1.5 inch. Further the dual density weight 880 can have a depth "B" measured between the first surface 882 and the second surface 883. In some constructions, the depth "B" can be between 0.1 and 1.5 inches. In other embodiments, the depth "B" can be between 0.1-0.4, 0.3-0.7, 0.6-1.0, 0.9-1.3, or 1.2-1.5 inches. For example, in some constructions, the depth "B" can be 0.1 inch, 0.15 inch, 0.20 inch, 0.25 inch, 0.3 inch, 0.35 inch, 0.4 inch, 0.45 inch, 0.5 inch, 0.55 inch, 0.6 inch, 0.65 inch. 0.7 inch, 0.75 inch, 0.8 inch, 0.85 inch, 0.9 inch, 0.95 inch, 1.0 inch, 1.05 inch, 1.1 inch, 1.15 inch, 1.2 inch, 1.25 inch, 1.3 inch, 1.35 inch, 1.4 inch, 1.45 inch, or 1.5 inch.

The base portion 881 can comprise a first material, and the shell portion 890 can comprise a second material. The first material can comprise a high density material, while the second material can comprise a lower density material similar to the material of the golf club head. The base portion 881 and shell portion 890 of the dual density weight 880 can be formed integrally while the golf club head 800 can be formed separately. The dual density weight 880 can be welded to golf club head 800 along the perimeter of the shell portion 890 comprising the second material. The first material can comprise a high density metal, such as tungsten, tantalum, rhenium, osmium, iridium, or platinum, or other high density metals. The second material can comprise a material having a lower density than that of the first material. Further, the second material can comprise a material similar to the material of the golf club head 800.

The dual density weight 880 can be utilized to redistribute the mass saved in the aforementioned deflection features. For example, any mass removed from the inserts 50, 150, 250, 350, or 450, the uniform thin sole 320, the cutout 770, or the optimized face material can be redistributed to the rear end of the club head 800 utilizing the dual density weight 880. Redistributing the mass to the rear end 824 of the golf club head 800 aids in moving the CG low and back and therefore, increasing the MOI.

As discussed above, the golf club head 10 having deflection features can comprise one of or any combination of the above described features (insert, insert with voids, thin uniform sole, cutout in top rail, optimized face material, and/or dual density weight). Therefore, the golf club head 10 can comprise any combination of golf club heads 100, 200, 300, 400, 500, 700, 800, and 100. Further, the golf club head 10 comprising the deflection features can be a single unibody cast reducing the manufacturing costs.

EXAMPLE 1

An exemplary golf club head 1000 comprising a reinforcement device 1112 having a looped rib was compared to a similar control club head, devoid of the reinforcement device using finite element analysis to simulate impact stresses. The reinforcement device 1112 of the exemplary club head 1000 includes a fillet between the outer perimeter of the reinforcement device and the rear surface of the face element, a face thickness that is thinner within the inner perimeter than without or outside the outer perimeter of the reinforcement device, and a rib span of 1.65 centimeters. Areas of high stress concentration on the exemplary club head 1000 discussed this example are indicated with reference number 1500 (see FIGS. 30 and 33). Areas of high stress concentration on the control club heads discussed in this example are indicated with reference number 2000 (see FIGS. 29, 31, and 32).

i. Fillet

The reinforcement element on the rear surface of the face element comprising a fillet between the outer perimeter of the reinforcement element and the rear surface of the face element, beneficially allows impact stresses to be transferred from the face element into the reinforcement element.

One of ordinary skill would expect the fillet between the outer perimeter of the reinforcement element and the rear surface of the face element to distribute impact stresses generally over a larger area at the interface between the face element and the reinforcement element. Upon impact with a golf ball, the fillet not only distributes stresses over a larger area at or near this interface, but also transfers stresses away from the interface, up and towards the end portion or rear end of the reinforcement element, away from the face element.

Figure 29A:
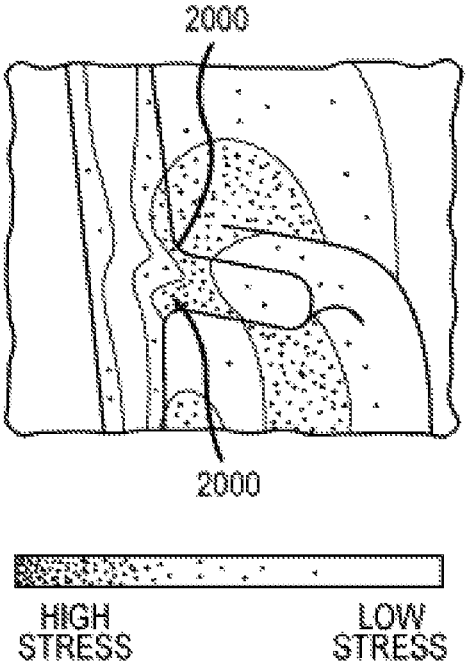
FIG. 29A is a perspective side cross-sectional view of a stress simulation of a control club head having a reinforcement device devoid of a fillet during impact with a golf ball.
Figure 29B:
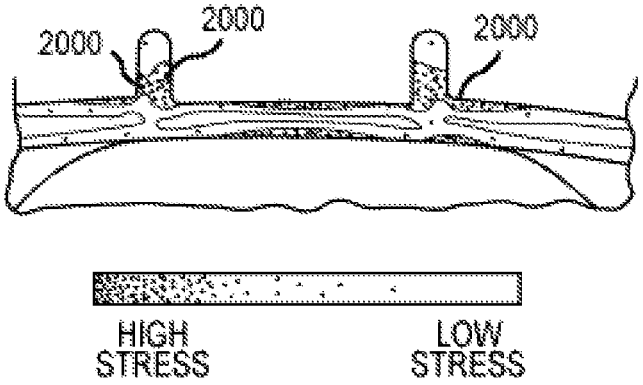
FIG. 29B is a side cross-sectional view of a stress simulation of a control club head having a reinforcement device devoid of a fillet during impact with a golf ball.
Figure 30A:
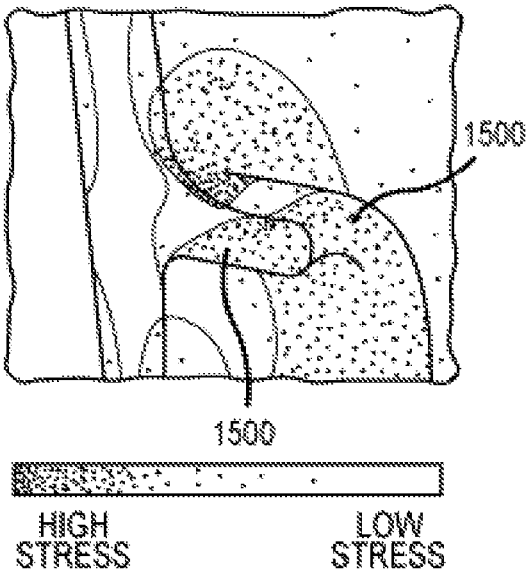
FIG. 30A is a perspective side cross-sectional view of a stress simulation of an exemplary golf club head having a reinforcement device with a fillet during impact with a golf ball.
Figure 30B:
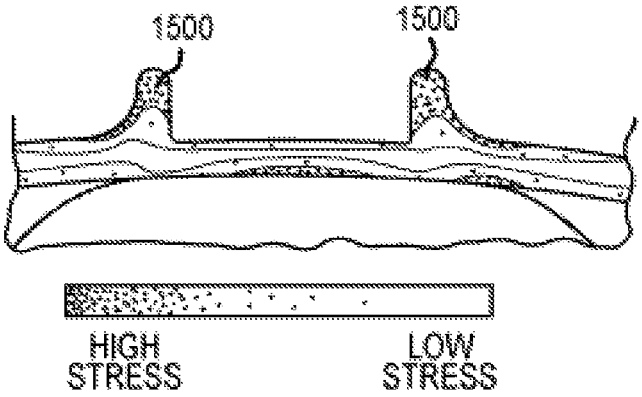
FIG. 30B is a side cross-sectional view of a stress simulation of an exemplary golf club head having a reinforcement device with a fillet during impact with a golf ball.

The transfer of stress at impact with a golf ball is illustrated in FIGS. 29 and 30 for the club head 1000 having the reinforcement device 1112 compared to a control club head having a reinforcement element devoid of the fillet. Referring to FIGS. 29A and 29B, at impact, areas of greatest stress 2000 are generated on the control club head at the interface of the reinforcement element with the face element and exhibit a familiar pattern associated with that of a stress concentrator at those locations. FIGS. 30A and 30B illustrate the efficient transfer of stress from the face element and into the end or rear portion of the reinforcement device, as a result of the fillet between the outer perimeter surface and the face element (particularly shown at the junction between the inner perimeter of the reinforcement device and the face element).

ii. Face Thickness

The transfer of impact stress away from the face element and into the reinforcement element allows the center of the face element to be thinned to increase face deflection and ball speed on impact with a golf ball. Accordingly, the face element can be thinner within the inner perimeter surface that without or outside the outer perimeter surface of the reinforcement element. Reduced face thickness allows greater bending at impact, thereby increasing energy transfer to a ball on impact to increase ball speed and travel distance.

Normally, reducing face thickness increases stress in the face element upon impact with a golf ball. The reduction in face thickness of the club head 1000 can be achieved without sacrificing durability (in fact, while reducing the stress on the face element), as a result of the reinforcement device. The efficient reduction in impact stress on the face element, while reducing the face element thickness within the inner perimeter of the reinforcement device relative to outside the outer perimeter of the reinforcement device results from the unique stress transfer properties of the fillet, as described above.

iii. Rib Span

The reinforcement device 1112 of the exemplary club head 1000 comprises a rib span of 1.65 centimeters. The rib span plays an important role in the amount of stress that is transferred from the face element into the end portion or rear end of the reinforcement device due to the fillet. Specifically, the rib span size allows the transfer of impact stress generated at the face into a hoop stress within the reinforcement device.

FIGS. 31-33 illustrate the transfer of stress at impact with a golf ball for the exemplary club head 1000 having reinforcement device 1112 compared to control club heads having a reinforcement element with a larger rib span and a smaller rib span than the exemplary club head 1000.

Figure 31A:
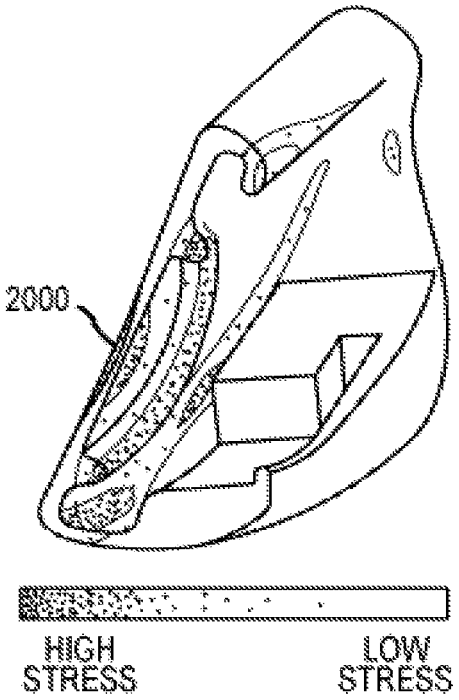
FIG. 31A is a perspective side cross-sectional view of a stress simulation of a control golf club head having a reinforcement device with large rib span during impact with a golf ball.
Figure 31B:
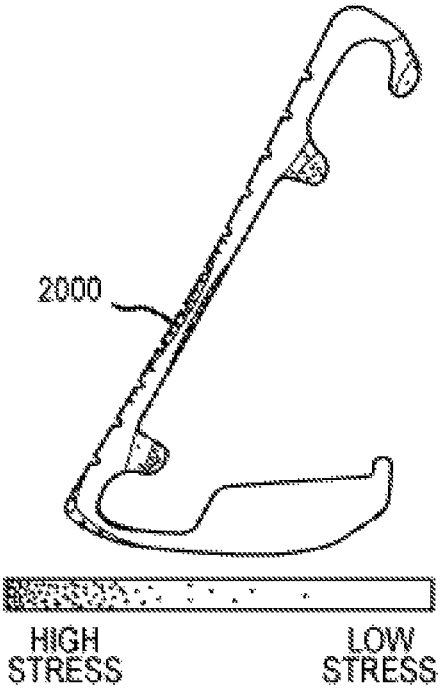
FIG. 31B is a side cross-sectional view of the club head of FIG. 31A.
Figure 31C:
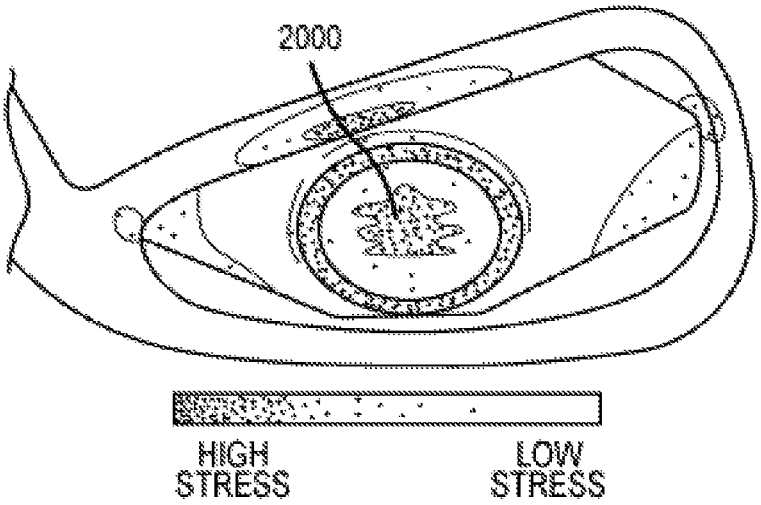
FIG. 31C is a rear perspective view of the club head of FIG. 31A.

Referring to FIGS. 31A-31C, a control club head comprises a reinforcement device having a rib span of 2.54 centimeters, larger than the rib span of the reinforcement device of the exemplary club head 1000. The rib span larger than the described rib span results in a large portion of the impact stress concentrating centrally on the front and rear of the face element, creating a stress riser on the face element.

Figure 32A:
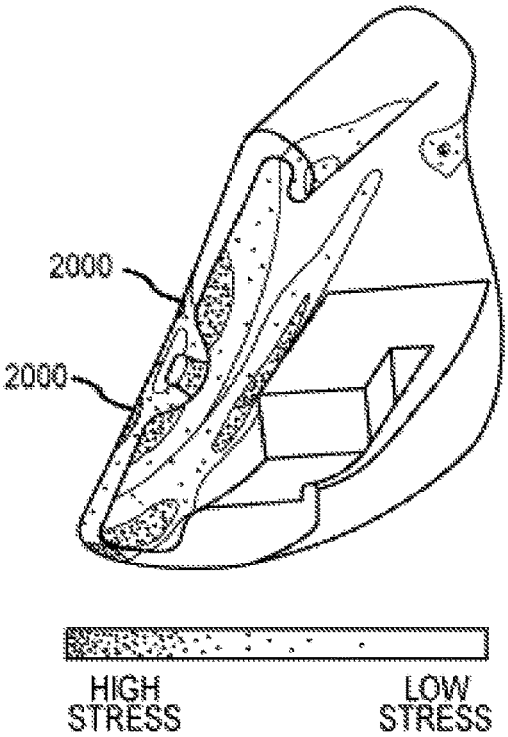
FIG. 32A is a perspective side cross-sectional view of a stress simulation of a control golf club head having a reinforcement device with small rib span during impact with a golf ball.
Figure 32B:
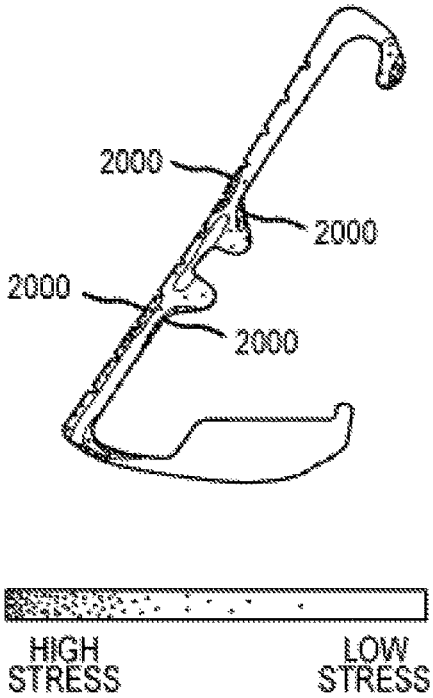
FIG. 32B is a side cross-sectional view of the club head of FIG. 32A.
Figure 32C:
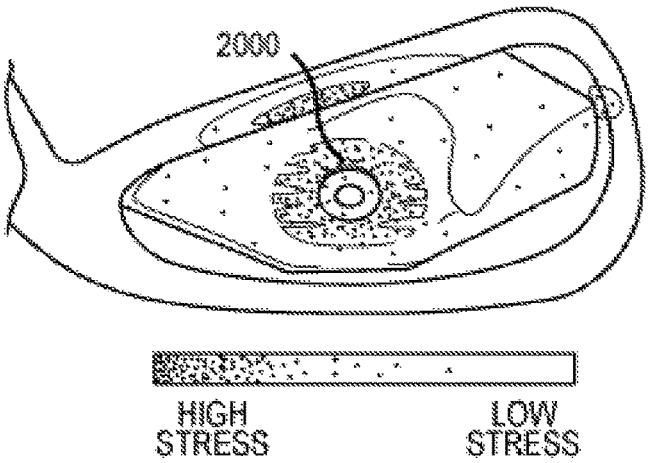
FIG. 32C is a rear perspective view of the club head of FIG. 32A.

Referring to FIGS. 32A-32C, a control club head comprises a reinforcement device having a rib span of 0.51 centimeter, smaller than the rib span of the reinforcement device of the exemplary club head 1000. The rib span smaller than the described rib span can result in a large portion of the impact stress concentrating on the front and rear of the face element around the perimeter of the reinforcement element, creating a stress rise on the face element.

Figure 33A:
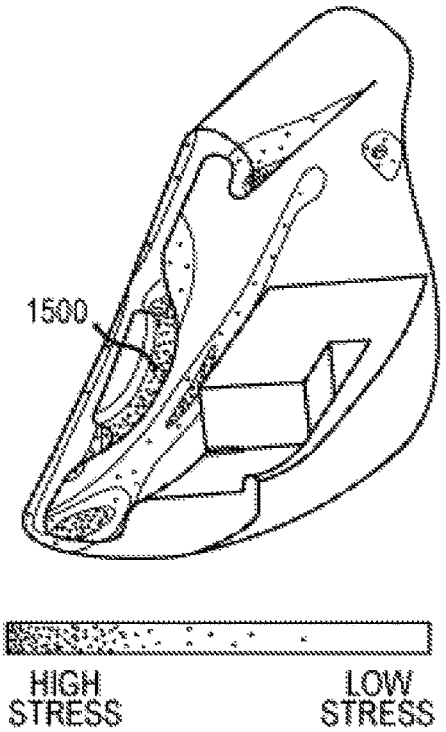
FIG. 33A is a perspective side cross-sectional view of a stress simulation of an exemplary golf club head having a reinforcement device with rib span according to the disclosure during impact with a golf ball.
Figure 33B:
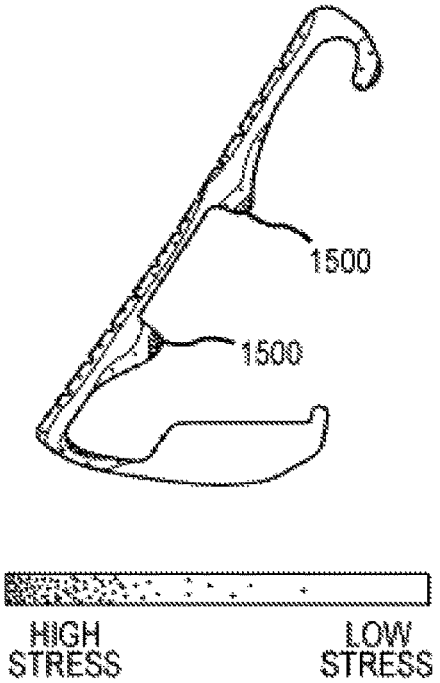
FIG. 33B is a side cross-sectional view of the club head of FIG. 33A.
Figure 33C:
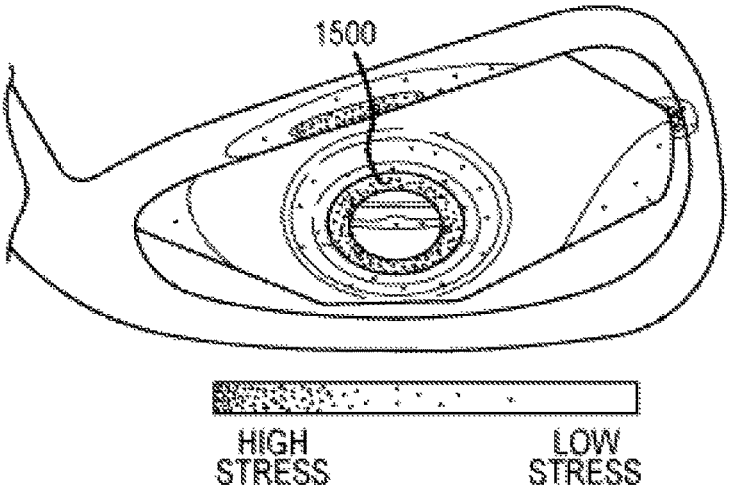
FIG. 33C is a rear perspective view of the club head of FIG. 33A.

Referring to FIGS. 33A-33C, the exemplary club head having a rib span of 1.65 centimeters, corresponding to the impact area of a golf ball results in significant stresses being transferred away from the face element and into the reinforcement device, thereby reducing the stress on the face element. The low tensile stress observed on the rear surface of the face element, as illustrated in FIGS. 33A-33C, having the described rib span and fillet, is an efficient stress distribution for a golf club/golf ball impact.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with an iron-type golf club, the apparatus and articles of manufacture described herein may be applicable to other types of golf club such as a driver type, a fairway wood-type golf club, a hybrid-type golf club, a wedge-type golf club, or a putter-type golf club. Alternatively, the apparatus and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A golf club head comprising:
a top end and a bottom end opposite the top end;
a front end and a rear end opposite the front end;
a toe end and a heel end opposite the toe end;
a face element comprising:
a face surface located at the front end and comprising a face center and a face perimeter; and
a rear surface located at the rear end and being opposite to the face surface, the rear surface comprising a rear center opposite the face center, and a rear perimeter; and
a reinforcement element located at the rear surface;
wherein:
the reinforcement element extends out from the rear surface toward the rear end and away from the front end;
the reinforcement element comprises a looped rib having an outer perimeter surface and an inner perimeter surface;
the face element is thinner within the inner perimeter surface than outside the outer perimeter surface;
the outer perimeter surface of the reinforcement element is filleted with the rear surface; and
the inner perimeter surface comprises a largest rib span of greater than or equal to approximately 0.609 centimeter to approximately 1.88 centimeters;
wherein:
a cavity is formed by a rear end interior wall, a sole interior surface, and a face interior surface;
a deflection feature, wherein the deflection feature is an insert positioned within the cavity;
the insert comprises an insert front surface positioned adjacent to the face interior surface, an insert rear surface positioned adjacent to the rear end interior surface, an insert bottom surface positioned adjacent to the sole interior surface, and a plurality of voids extending through at least a portion of the insert; and
wherein the plurality of voids
comprises between 30% and 70% voids;
wherein the percentage of voids is defined as a volume of voids compared to a volume of insert material.

2. The golf club head of claim 1 wherein:
the golf club head comprises an iron-type golf club head.

3. The golf club head of claim 1 wherein at least one of:
the rear surface is nearer to the face surface at the face center than proximal to the face perimeter; or
a center thickness from the face center to the rear center is less than or equal to approximately 0.203 centimeter.

4. The golf club head of claim 1, wherein:

an x-axis extends parallel to the face surface and intersects the rear center;

a y-axis extends parallel to the face surface, extends perpendicular to the x-axis, and intersects the rear center;

a z-axis extends perpendicular to the face surface, extends perpendicular to the x-axis and the y-axis, and intersects the rear center;

the x-axis extends through the toe end and the heel end and equidistant between the top end and the bottom end;

the y-axis extends through the top end and the bottom end and equidistant between the toe end and the heel end;

the z-axis extends through the front end and the rear end and equidistant (i) between the toe end and the heel end and (ii) between the top end and the rear end; and at least one of:

the looped rib is symmetric about the x-axis; or the looped rib is symmetric about the y-axis.

5. The golf club head of claim 1 wherein:

the looped rib comprises an elliptical looped rib.

6. The golf club head of claim 5 wherein:

the elliptical looped rib comprises a circular looped rib.

7. The golf club head of claim 1 wherein:

the inner perimeter surface of the looped rib is filleted with the rear surface.

8. The golf club head of claim 1 wherein:

the golf club head further comprises a perimeter wall element extending out from the rear surface toward the rear end and away from the front end, the perimeter wall element comprising:

a first perimeter wall portion extending along the rear perimeter of the rear surface at the top end; and a second perimeter wall portion extending along the rear perimeter of the rear surface at the bottom end.

9. The golf club head of claim 1 wherein:

a rib thickness between the inner perimeter surface of the looped rib and the outer perimeter surface of the looped rib is approximately 0.0508 centimeter to approximately 1.448 centimeters.

10. The golf club head of claim 1, wherein the concentration of voids near an insert top surface is greater than a concentration of the voids near the insert bottom surface.

11. The golf club head of claim 1, wherein a concentration of voids is greater near the front insert surface than the rear insert surface.

12. The golf club head of claim 1, wherein a portion of the plurality of voids are not open to the insert front surface or the insert rear surface.

13. The golf club head of claim 1, wherein the top end comprises a top rail; and wherein the top rail further comprises a cutout in the top rail adjacent to the rear surface of the face.

14. The golf club head of claim 1, wherein the golf club further comprises a weight.

15. The golf club head of claim 14, wherein the weight is a dual-density weight comprising a weight base portion and a weight shell portion;

wherein the weight base portion comprises a first surface exposed to the exterior of the golf club head;

wherein the weight shell portion surrounds all surfaces of the base portion except the first surface.

16. The golf club head of claim 15, wherein the base portion comprises a first material and the shell portion comprises a second material;

wherein the first material comprises a first weight density and the second material comprises a second weight density;

and wherein the second weight density is lower than the first weight density.

17. The golf club head of claim 1, wherein the looped rib inner perimeter surface and the rear surface define an inner loop cavity.

18. The golf club head of claim 17, wherein the inner loop cavity receives a reinforcement element insert.

* * * * *